US011626275B2

(12) United States Patent
Eiler et al.

(10) Patent No.: US 11,626,275 B2
(45) Date of Patent: Apr. 11, 2023

(54) ISOTOPIC MASS SPECTROMETER

(71) Applicants: Thermo Fisher Scientific (Bremen) GmbH, Bremen (DE); California Institute of Technology, Pasadena, CA (US)

(72) Inventors: John M. Eiler, Sierra Madre, CA (US); Simon Cajetan Neubauer, Los Angeles, CA (US); Michael J. Sweredoski, Altadena, CA (US); Jens Griep-Raming, Ganderkesse (DE)

(73) Assignee: Thermo Fisher Scientific (Bremen) GmbH, Bremen (DE)

( * ) Notice: Subject to any disclaimer, the term of this patent is extended or adjusted under 35 U.S.C. 154(b) by 0 days.

(21) Appl. No.: 17/266,991

(22) PCT Filed: Aug. 13, 2019

(86) PCT No.: PCT/EP2019/071750
§ 371 (c)(1),
(2) Date: Feb. 8, 2021

(87) PCT Pub. No.: WO2020/035505
PCT Pub. Date: Feb. 20, 2020

(65) Prior Publication Data

US 2021/0313160 A1 Oct. 7, 2021

Related U.S. Application Data

(60) Provisional application No. 62/718,137, filed on Aug. 13, 2018.

(51) Int. Cl.
*H01J 49/00* (2006.01)
*H01J 49/42* (2006.01)

(52) U.S. Cl.
CPC ..... *H01J 49/0036* (2013.01); *H01J 49/0031* (2013.01); *H01J 49/0045* (2013.01); *H01J 49/425* (2013.01)

(58) Field of Classification Search
CPC ..... H01J 49/0036; H01J 49/0031; H01J 49/0045; H01J 49/425
(Continued)

(56) References Cited

U.S. PATENT DOCUMENTS 9,111,735 B1 8/2015 Nikolaev et al.
2005/0255606 A1* 11/2005 Ahmed ..... G06K 9/00503 436/173

(Continued)

OTHER PUBLICATIONS

Davies et al., "Towards Defining the Urinary Proteome Using Liquid Chromatography—Tandem Mass Spectrometry II. Limitations of Complex Mixture Analyses," Proteomics, Jan. 2001, vol. 1, No. 1, pp. 108-117. XP55633090.

(Continued)

*Primary Examiner* — Nicole M Ippolito

(57) ABSTRACT

A method for determining an isotopic profile for a molecule is provided. The isotopic profile is indicative of an isotopic content for the molecule. The method comprises mass selecting ions of the molecule in a mass window, the mass window excluding a mass for a monoisotopic molecular ion and including a mass for at least one isotopic variant of the monoisotopic molecular ion. The method comprises fragmenting the mass selected ions into fragment ions, performing mass analysis on one or more of the fragment ions to produce a mass spectrum, and determining the isotopic profile for the molecule, the isotopic profile comprising at least one data value. Each data value is calculated for a fragment ion as a function of intensities of multiple peaks in the mass spectrum. A computer program is provided. A mass (Continued)

spectrometry system is provided. A method for identifying a sample is provided.

27 Claims, 13 Drawing Sheets

(58) Field of Classification Search
USPC ..... 250/281, 282, 283
See application file for complete search history.

(56) References Cited

U.S. PATENT DOCUMENTS

| | | | | |
|---|---|---|---|---|
| 2007/0158542 | A1* | 7/2007 | Bauer | H01J 49/0036 250/282 |
| 2015/0214020 | A1* | 7/2015 | Decker | H01J 49/0036 250/283 |
| 2016/0139140 | A1* | 5/2016 | Thompson | C07D 401/12 506/4 |
| 2018/0226238 | A1 | 8/2018 | Griep-Raming | |

OTHER PUBLICATIONS

International Search Report and Written Opinion dated Oct. 25, 2019 to PCT Application No. PCT/EP2019/071750.
International Preliminary Report on Patentability dated Jun. 5, 2020 to PCT Application No. PCT/EP2019/071750.

* cited by examiner

ISOTOPIC MASS SPECTROMETER

CROSS-REFERENCE TO RELATED APPLICATIONS

This application is a National Stage application filed under 35 USC § 371 of International Patent Application No. PCT/EP2019/071750, filed on Aug. 13, 2019. PCT Application No, PCT/EP2019/071750, claims priority to U.S. Provisional Application No. 61/718,137, filed Aug. 13, 2018, both of which are incorporated by reference herein in their entirety.

TECHNICAL FIELD OF THE DISCLOSURE

The present disclosure relates to methods and systems for determining isotopic profiles for molecules using mass spectrometry and identifying molecules using such profiles.

BACKGROUND TO THE DISCLOSURE

Mass spectrometry is widely used for analysis of substances in various fields including, for example, geochemistry, biochemistry, environmental chemistry, medical diagnostics and forensics. In these fields, it is known that the isotopic signature of a molecule may be inferred based on mass spectral data and used to infer information about the origin or age of the molecule.

Attempts have been made (for example, see U.S. Pat. No. 9,111,735) to determine elemental compositions for molecules based on high-resolution mass spectra having resolvable isotopic peaks. Such methods involve analysing mass spectra in order to attempt to count the number of atoms present in a molecule. However, the precision with which isotopic mass spectral data can be interpreted is limited by low abundances of the isotopes measured and the number of ions detected. The number of ions detected is, in turn, limited by the space charge capacity of ion optical storage elements in mass spectrometers. Typical organic molecules consisting of carbon, hydrogen, nitrogen, sulphur and/or oxygen each have stable isotopic variants, but the natural abundances of these isotopes are relatively low. This has meant that very few studies into intramolecular isotopic structure using mass spectrometry have been conducted.

Thus, to date, investigations into the intramolecular isotopic content of molecules have largely been restricted to analysis using NMR, which is expensive and requires relatively large samples for accurate analysis. It would be desirable if the intramolecular isotopic content of substances could be determined for small samples both quickly and accurately.

SUMMARY OF THE DISCLOSURE

Against this background, there is provided a method for determining an isotopic profile for a molecule, as defined in claim 1. Also provided are a computer program as defined in claim 25, a mass spectrometry system as defined in claim 26 and a method for identifying a sample as defined in claim 27.

The present disclosure relates generally to a method for analysing the isotopic content within a molecule using mass spectrometry. Generally, the method applies to analysing a molecule that contains at least one rare, typically heavy, isotope. First, ions of a molecule (or a fragment ion) within a specific mass window are mass selected. The mass window may be chosen so that the resultant mass selected ions contain a larger proportion of ions having rare isotopes than a typical sample of ions would contain. This is achieved by setting the mass window such that monoisotopic ions are excluded, whilst one or more isotopologues of the monoisotopic ions are included. The selected isotopologues thus contain at least one rare isotope. Since monoisotopic ions are (by definition) devoid of isotopes, this leads to an isotopically enriched sample of ions for subsequent analysis. In practice, for many common isotopes, this involves mass selecting ions of the M+1 and/or M+2 and/or M+3 . . . etc. peak, where M is the monoisotopic peak mass. Thus, rare isotopes may be targeted.

Once an isotopically enriched sample of ions is generated, the ions are fragmented and a mass spectrum of the resultant fragments is generated. The peak intensities in the resultant mass spectrum are a rich source of information about the sample. For instance, in a molecule containing several carbon atoms, the distribution of $^{13}C$ isotopes within the molecule may lead to different fragments derived from the molecule having different $^{13}C$ contents. Thus, a peak in the mass spectrum that relates to a fragment of the molecule that contained a relatively high abundance of $^{13}C$ might have a much more prominent M+1 peak than a peak in the mass spectrum that relates to a fragment that is relatively depleted in $^{13}C$.

This may be exploited to generate a set of data values for the molecule that comprises one or more values derived from peak intensities in the mass spectrum. Such values could include, for example, the ratio of the M+1 peak intensity relative to the M peak intensity for one or more fragments in the mass spectrum. Such peak intensity ratios may be denoted as M0/M+x, where M0 is the intensity of the peak due to the monoisotopic isotopologue of the fragment ion and M+x is the intensity of the peak due to the heavy isotopologue of the fragment ion. Since the fragmentation pathway of a molecule is generally closely related to its molecular structure, data values derived from the mass spectrum in this way may be linked to specific locations in the molecule, rather than simply being associated with mass values of fragment ions. Thus, atomic site-specific or moiety-specific intramolecular isotopic distributions may be inferred for the molecule using mass spectrometry alone.

Such set of data values may be used as characteristic profiles for molecules, because these set of data values are demonstrably capable of distinguishing between samples from different sources reliably and repeatedly. A set of data values for a sample generated in accordance with these methods may be used as an identifier for a sample, since the isotopic distribution in a molecule may be indicative of a particular synthesis pathway or sample origin. Thus, the origin or synthesis of an unknown sample could be inferred by analysing the sample using the methods of the present disclosure and comparing the resultant profile data with data in a data store for previously analysed samples.

BRIEF DESCRIPTION OF THE DRAWINGS

The disclosure may be put into practice in various ways, which will now be described by way of example only and with reference to the accompanying drawings in which:

FIG. 9*a* shows a high-resolution set of data values for analysis of Met; a

DETAILED DESCRIPTION OF PREFERRED EMBODIMENTS

The present disclosure will now be illustrated by reference to the accompanying drawings. First, hardware arrangements and general principles suitable for implementing methods of the present disclosure are described by reference to FIGS. 1 and 2. Then, a worked example is provided in which samples of Met are analysed using the methods of the present disclosure, as illustrated in FIGS. 3 to 9.

SUITABLE HARDWARE AND GENERAL PRINCIPLES OF ANALYSIS

Figure 1:
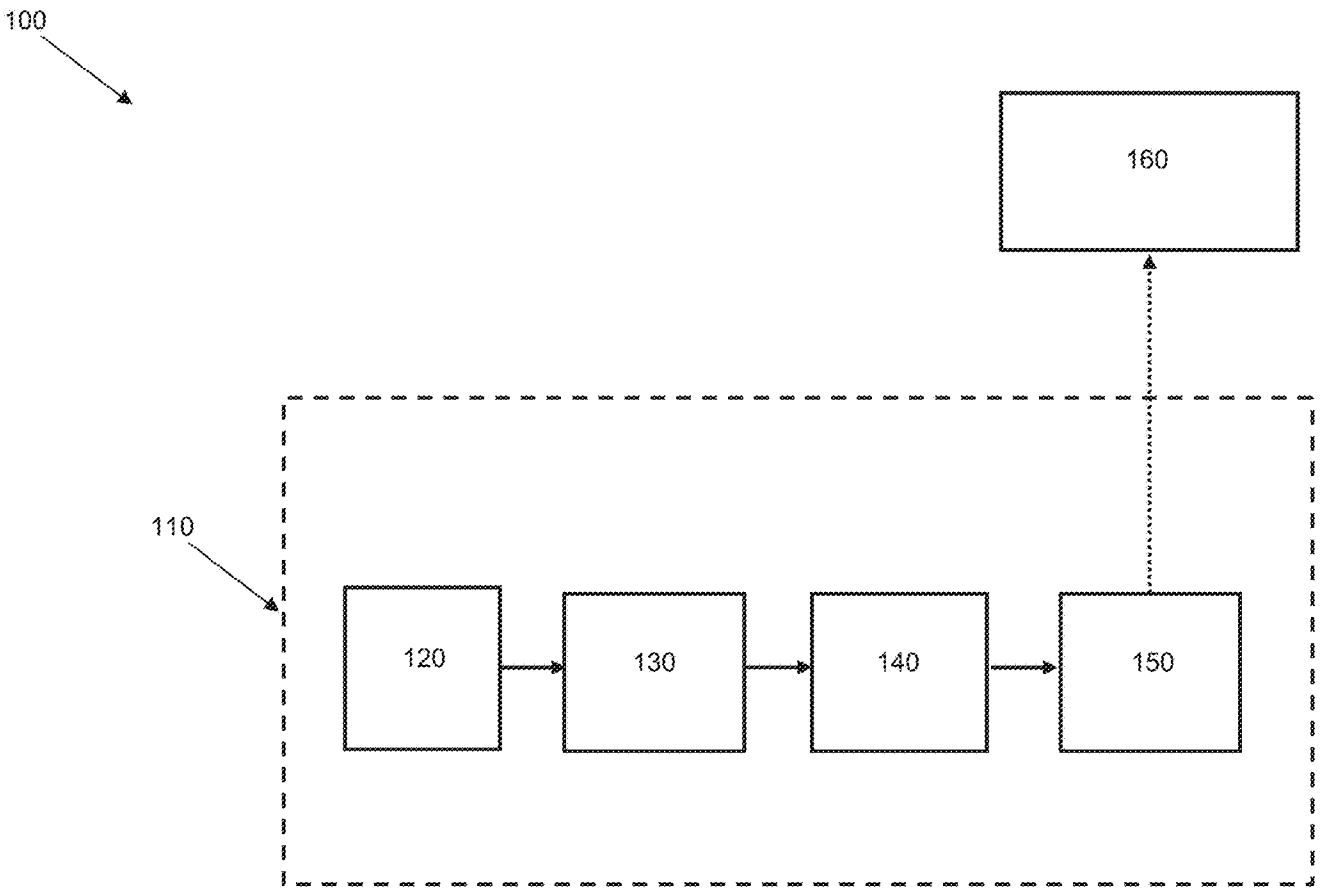
FIG. 1 shows a schematic diagram of an exemplary known system, using which embodiments of the present disclosure may be implemented.

Referring to FIG. 1, there is shown a schematic diagram of an exemplary system, using which an embodiment of the present disclosure may be implemented. The exemplary system 100 comprises a mass spectrometry system 110 connected to a computer system 160 for analysing data generated by the mass spectrometry system 110.

The mass spectrometry system 110 is of customary design and comprises a source of ions 120, a mass selector 130, a fragmentation device 140 and a mass analyser 150 comprising a detector. Signals from the analyser 150 are processed and analysed by the computer system 160. The computer system 160 may additionally be configured to control the operation of mass spectrometry system 110 to perform the methods of the present disclosure.

Figure 2A:
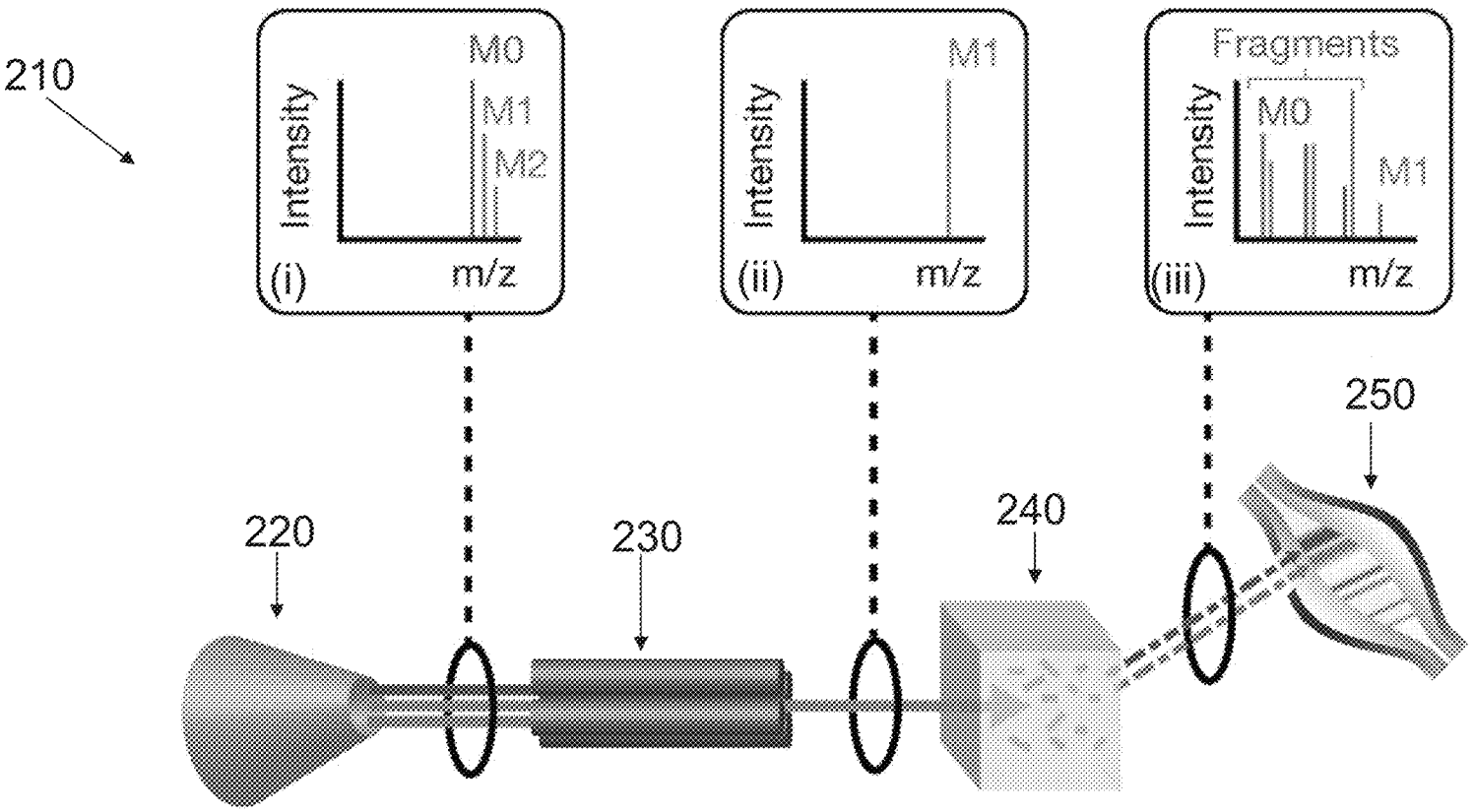
FIG. 2*a* shows schematically a mass spectrometry system configured to analyse to generate data for analysis using embodiments of the disclosure.

Referring now to FIG. 2*a*, there is depicted a preferred example of a mass spectrometry system 210 that may be used to quantify isotopic heterogeneity in molecules. The system 210 of FIG. 2*a* is a specific example of the exemplary system of FIG. 1. In this embodiment, ions are generated by electrospray ioniser 220 and those ions within a specific mass window are filtered by a quadrupole mass filter 230. It will be appreciated that, in other embodiments, other means of mass selection known in the art could be used in place of the quadrupole mass filter, for example an ion trap mass analyser, or a mass selector based on time of flight of ions. Then, fragmentation occurs in the fragmentation device of the mass spectrometry system, which is a fragmentation cell 240 in the embodiment of FIG. 2*a*. Ions are then transferred to an orbital trapping mass analyser 250 (for example, an Orbitrap™ mass analyser manufactured by Thermo Fisher Scientific™) for mass analysis. A suitable system for this process is the Q Exactive™ hybrid quadrupole-orbital trapping mass spectrometer manufactured by Thermo Fisher Scientific™. Shown in FIG. 2*a* are mass spectra of the species transferred between the components, although these are for illustrative purposes and are not necessarily measured at each stage of the methods disclosed herein.

It will be appreciated that the present disclosure refers to mass values, whereas mass selection and analysis filter and measure based on mass-to-charge ratios. For the sake of simplicity, the present disclosure generally describes only singly-charged fragments, which means that all mass values expressed herein have the same numerical values when expressed as m/z values. Thus, the term mass is used interchangeably with mass-to-charge ratio throughout this disclosure. However, it will be appreciated that mass selection of multiply-charged molecular ions and analysis of multiply-charged fragment ions may be performed in the same way as for singly-charged fragment ions and that the disclosed methods are equally applicably to analysis of multiply-charged ions and singly-charged ions, including the fact that changes in charge numbers may occur during fragmentation of multiply charged ions.

In the spectrum of FIG. 2*a*(i), it can be seen that the molecular ions generated by the electrospray ionisation comprise monoisotopic ion peaks at mass M0, M+1 (M1) peaks that differ in mass from the M0 peak by 1 atomic mass unit, and M+2 (M2) peaks that differ from the M0 peak by 2 atomic mass units. Molecular ions that contain at least one rare isotope, in this case having a mass of M+1 (although any M+x ions could instead be isolated, where x is an integer), are isolated by quadrupole mass filter 230, which mass selects ions within a mass window selected so as to isotopically enrich the ions. In FIG. 2*a*(ii), there is shown a mass spectrum for the M+1 peaks, illustrating that after passing through the quadrupole mass filter 230, mass selected ions have substantially the same nominal mass, M+1.

Mass selected ions are transferred to fragmentation cell 240 and fragmented, before being passed to an orbital trapping mass analyser 250 for mass spectrometric analysis to ascertain which fragments are enriched or depleted in rare isotopes. It can be seen from the resulting mass spectrum, shown in FIG. 2*a*(iii), that the fragments that result from isolation and fragmentation of the M+1 peak contain monoisotopic M0 peaks and M+1 peaks, even though the ions from which the fragments were derived were isotopically enriched and devoid of monoisotopic species. It is apparent that the relative intensities of the M+1 and M0 peaks vary amongst the fragments, reflecting the non-uniform distribution of isotopes within each fragment. This heterogeneity is a powerful source of information that may be analysed using the methods of the present disclosures.

For simplicity, the present examples focus on measurements where the initial mass isolation selects molecular ions that have one extra mass unit (M+1), in this example using a quadrupole of a Q Exactive™ mass spectrometer. In this case, the precursor ion isolation window is beneficially set to be centred on the mass M+1 and sufficiently narrow (e.g. 1 Da or less) so that neither the monoisotopic molecular ions (M0) nor molecular ions having two extra mass units (M+2) or higher are transferred for fragmentation. However, the methods of the present disclosure may also be applied to molecular ions containing more than one rare isotope. Thus, it will be appreciated to those skilled in the art that for site-specific distributions of isotopes weighing 2 or more Da above their most abundant form (e.g. $^{18}O$), or clumped isotope species (i.e. containing two or more rare isotopes in the same molecule, for example $^{13}C$ and $^{13}C$, or $^{15}N$ and $^{13}C$, or $^{2}H$ and $^{13}C$), then M+2, M+3 or other suitable higher mass peaks may be isolated. In some embodiments, a mass selection window width of 1 Da or less may be used to isolate only the M+2, or M+3, . . . mass ions. In some embodiments, the method comprises mass selecting ions of the molecule in a mass window that includes a mass M+x, where M=mass of the monoisotopic ion of the molecule, x=an integer (typically 1, 2, 3, or higher) corresponding to the additional nominal mass of the at least one heavy isotope, wherein the mass window excludes ions having mass (M+x−1) and ions having mass (M+x+1). In such embodiments, the mass window is preferably centred on the mass M+x. In such embodiments, the mass selection window width is preferably 1 Da or less.

In some other embodiments, an isolation window of 2 Da or more may be used to simultaneously isolate molecular ions of interest of different nominal mass, whilst excluding the monoisotopic peak. Preferably, the mass window is selected such that it isolates the isotopologues in a range starting with the M+1 ion, up to the M+x ion, where x refers to the highest isotope peak to be isolated. However, in some embodiments, the mass window is selected such that it simultaneously isolates the isotopologues in a range starting with the M+2 ion, up to the M+x ion. In typical implementations of such embodiments, at least the M+1 and the M+2 isotope peaks are isolated and fragmented. This allows all major +1 isotopes (e.g. $^{13}C$, $^{15}N$, $^{2}H$, $^{17}O$) as well as +2 isotopes (e.g. $^{18}O$, $^{34}S$, $^{81}Br$, $^{37}Cl$) to be measured in a single measurement mode, provided that the resolution selected for the mass analysis is sufficiently high. Generally, when the mass window is selected such that it isolates isotopologues starting with the M+n ion, up to the M+x ion (n here refers to the lowest isotope peak being isolated), a selection window width substantially (x−n+1) Da wide may be used. For example, when co-selecting M+1 molecular ions up to M+x molecular ions, a selection window width substantially x Da wide may be used. The mass window preferably excludes the M+n−1 and lower molecular ions and exclude the M+x+1 and higher molecular ions. Suitable mass selection windows are readily attainable using the mass spectrometry systems disclosed herein.

Isolated ions generated in this way are then subjected to fragmentation.

Fragmentation of the mass selected molecular ions may be achieved using the higher energy collision dissociation (HCD) fragmentation cell 240 of the mass spectrometer, which creates a mixture of fragment peaks, each of which occurs in its monoisotopic form and in its singly substituted form. The intensity ratio (M0/M+1) for a fragment ion will depend on the probability that the +1 Da isotopes that were part of the full molecular M+1 ion were transferred to that specific fragment ion. Typically, this ratio will be larger for smaller fragment ions, as small subsets of atoms from the molecule have smaller probabilities of inheriting the heavy rare isotope. However, when the M0/M+1 ratio for a given fragment ion is compared between two samples of the same molecule analysed under otherwise identical conditions, differences in the abundance and distribution of +1 isotopes manifest as small differences of M0/M+1 ratios.

The present disclosure may be implemented using low-resolution modes (e.g. resolving power R=15000 at m/z 200), where the majority of nearly isobaric M+1 species are recorded as one peak, thereby combining signals from ions that contain e.g. $^{2}H$, or $^{13}C$, or $^{15}N$, or $^{17}O$ or $^{33}S$. Additionally or alternatively, the present disclosure may be performed in high-resolution modes (here R=240000, for instance), where most or all nearly isobaric species (i.e. peaks having the same nominal mass but different exact masses) are observed as separate M+1 peaks. The hardware arrangements disclosed in FIGS. 1 and 2 may be configured to collect data across a wide range of resolutions. Data collection at a low mass resolving power increases the speed of spectra collection to 24 Hz, as compared to up to 2 Hz when higher resolutions are utilised. Faster acquisition allows more ions to be analysed per unit time, thereby decreasing analytical duration and the required sample quantities to achieve a given target precision in measured ratio or ratios. An advantage of high-resolution mode of analysis is that it provides more precise constraints on the site-specific distribution of $^{13}C$ and other +1 Da isotopes present in the parent molecule. For some applications, such as relatively simple forensic discrimination, or tracing of an introduced isotopic label, the low-resolution mode is suitable and in some cases preferable. In other areas such as detailed study of molecular isotopic structure or complex, high dimensionality forensic fingerprinting, higher resolutions are preferable (e.g. 50000 or higher, or 100000 or higher, or 200000 or higher). Higher resolutions of 1000000 can be achieved.

Figure 2B:
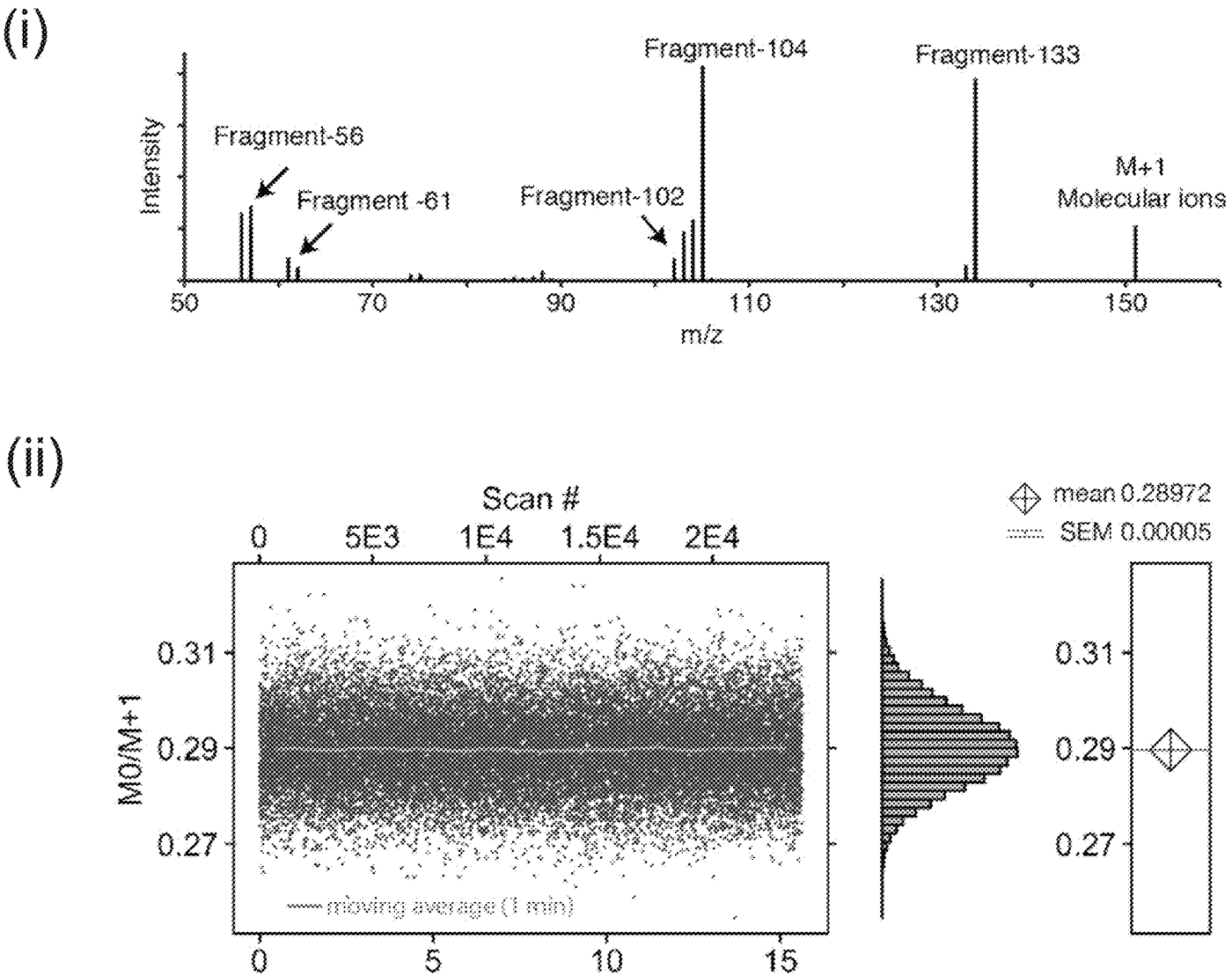
FIG. 2*b* shows a mass spectrum (i) generated and (ii) analysed in accordance with the present disclosure.

As an example, data collection in low-resolution mode (e.g. 15000 formal resolution) for 15 minutes results in more than 22000 scans. Measured ion ratios for each scan are symmetrically distributed around their geometric mean, which shows only minor fluctuations in 'local' mean over the course of data acquisition. This distribution enables quantification of the average measured peak intensity ratio with a relative standard error of the mean (RSE) on the order of 0.1 permil (relative), which is small when compared to many natural isotopic variations and well established techniques for molecule-average measurements of C isotope ratios. The RSE of measurements over timescales of between a minute to an hour are at shot noise limits, based on estimates of numbers of ions observed per scan. Thus, those skilled in the art will recognise that the time spent for data acquisition may be readily adjusted to reach a desired precision. The methods and principles described above are illustrated now by reference to an experimental analysis of Methionine (Met), in order to demonstrate the utility of the disclosed methods. Referring next to FIG. 2*b*(i), there is shown a mass spectrum of Met and its fragments generated using the methods of the present disclosure. Met ionises primarily as a $[M+H]^+$ molecular ion with a nominal mass of m/z 150 by electrospray ionisation. Shown in the mass spectrum of FIG. 2*b*(i) is a molecular ion peak having a mass M+1 with no corresponding molecular ion peak at mass M (150), indicating the isolation of an isotopic variant of the molecular ion peak and the exclusion of the monoisotopic peak. Also shown in this mass spectrum are five peak groups associated with five fragment ions. Throughout the present disclosure, the fragment ions are labelled by their M0 peak mass. As can be seen, the peak groups comprise principal peaks and isotopic variants thereof, the intensities of which may be used to calculate data values such as peak intensity ratios.

For illustration, in FIG. 2*b*(ii) there is shown a set of data values comprising M0/M+1 ratios calculated throughout the duration of an experiment, for one of the five fragments of Met. The calculated peak intensity ratios are randomly distributed about a mean value of 0.28982. A moving average is depicted, illustrating the stability of the calculated mean. At the right hand side of FIG. 2*b*(ii), the mean and standard error in the mean (0.00005) are depicted together. It will be appreciated that the total number of scans can be determined and adjusted during analysis so as to obtain a target margin error. This may be achieved using standard statistical methods.

The peaks of the M0 and M+1 fragment ions have more comparable intensities than would occur without initial mass selection. In the case of Met, the M0/M+1 ratios are 0.07 for the largest fragment and 0.8 for the smallest fragment. This means that many fragments can be simultaneously detected and quantified without the risk that an important peak will be lost because the peak intensity falls below the noise threshold of the measured mass spectrum.

In general terms, the present disclosure provides a method for determining an isotopic profile for a molecule, the isotopic profile indicative of an isotopic content for the molecule, the method comprising: mass selecting ions of the molecule in a mass window, the mass window excluding a mass for a monoisotopic molecular ion and including a mass for at least one isotopic variant of the monoisotopic molecular ion; fragmenting the mass selected ions into fragment ions; performing mass analysis on one or more of the fragment ions to produce a mass spectrum; and determining the isotopic profile for the molecule, the isotopic profile comprising at least one data value, each data value calculated for a fragment ion as a function of intensities of multiple peaks in the mass spectrum.

The isotopic profile for the molecule may be any data structure comprising isotopic data values that are derived from peak intensities. In other words, the isotopic profile may be an intramolecular isotopic distribution. The isotopic profile may also be used to observe and characterise multiply-substituted species. Properties of multiply-substituted species are not strictly intramolecular properties, because the abundance of a multiply-substituted species reflects the probability that two rare isotopes occur in one molecule, rather than being distributed across two molecules of the same compound.

Thus, the isotopic profiles of the present disclosure advantageously encode information about the distribution of isotopes within the molecules in a sample.

Each isotopic data value may be associated with, for instance, one or more of an associated fragment mass, a fragment name, a fragment chemical composition, or a position within the molecule. Preferably, the isotopic profile comprises a plurality of data values. As the fragment ions of the molecule may be related to the structure of the molecule, each fragment may be used to infer isotopic data values for a specific portion of the molecule. Thus, variations in isotopic content in a plurality of sites in a molecule may be analysed. In some embodiments, the isotopic profile for the molecule may be used as a fingerprint to identify its origin.

The mass window that excludes a mass for a monoisotopic molecular ion and includes a mass for at least one isotopic variant of the monoisotopic molecular ion may lead to a sample that is enriched with either heavy or with light isotopes (but typically heavy isotopes). Thus, the present disclosures may be used to infer isotopic distributions or profiles for a wide variety of molecules having both heavy and light isotopologues. Advantageously, mass selecting a subset of ions that are nearly uniform in mass minimises the influence of isotope fractionations that occur prior to and during mass selection. Removing the monoisotopic full molecular ions leads to isotopic enrichment of the population of analysed ions, which makes rare isotopologues more abundant as a fraction of all analysed ions.

Advantageously, the methods of the present disclosure may be applied to ions containing more than one rare isotope, enabling thorough and accurate analysis of samples. The present disclosure may help to improve the precision and accuracy for position-specific isotope ratio measurements on high resolution mass spectrometers (e.g. with capability for R=50000 or more, or R=100000 or more, such as, hybrid Quadrupole-Orbital trap mass spectrometers, or hybrid Quadrupole-time-of-flight (QToF) mass spectrometers, or high resolution Quadrupole-magnetic sector mass spectrometers) by increasing the fraction of analyte ions containing a rare isotope delivered to the mass analyser for analysis and reduces the analysis time needed for position-specific isotope analysis. Moreover, the amount of sample used for one analysis (<3 nmol for 15 min of direct infusion in embodiments of the disclosure) is approximately five orders of magnitude less than required for isotope analysis by NMR. Thus, accurate position-specific isotope ratios may be determined using the present disclosures using relatively small sample sizes with mass spectrometry systems that are far more simple to use and less expensive than NMR systems.

In preferred embodiments of the disclosure, the generated mass spectrum of the fragment ions comprises one or more peak groups, each peak group comprising: a principal peak associated with a monoisotopic fragment ion; and at least one variant peak, each variant peak associated with an isotopic variant of the monoisotopic fragment ion.

In other words, each fragment ion peak in the mass spectrum may have one or more variant peaks that are associated with isotopologues of the monoisotopic fragment ion. For instance, a fragment ion containing oxygen may have two isotopic variant peaks due to the presence of $^{17}O$ and $^{18}O$, in addition to the monoisotopic peak of the fragment ion that contains only the most naturally abundant $^{16}O$. Aspects of the disclosure may analyse one or both of the variant peaks associated with each fragment ion to provide a comprehensive isotopic profile for the molecule. The isotopic profile may thus provide a profile for the whole molecule, or for a portion of the molecule.

Optionally, fragmenting the mass selected ions comprises generating at least two fragment ions, each of the at least two fragment ions associated with respective, different peak groups in the mass spectrum. In this way, a specific intramolecular distribution of the isotopic content of a molecule may be determined using mass spectrometry alone. Whilst such implementations are advantageous, it will be appreciated that the methods of the present disclosure do not necessarily require two fragment peak ions, because useful data may be obtained when only one fragment ion species is formed, provided that the fragment differs in stoichiometry from the molecular ion peak that was originally chosen in the mass window (i.e. differs in the number of atoms of the element whose isotopes are used to determine the data values).

In preferred embodiments, the methods of the present disclosure comprise determining each data value in the isotopic profile for a respective peak group, each data value being calculated as a peak intensity ratio between the principal peak and the variant peak of the respective peak group. In other words, the method may comprise determining, for one or more, and preferably two or more, of the fragment ions in the mass spectrum, an intensity ratio M0/M+x, wherein M0 is the intensity of the peak due to the monoisotopic isotopologue of the fragment ion and M+x is the intensity of the peak due to the heavy isotopologue of the fragment ion.

Advantageously, comparing the intensity of the M0 monoisotopic peak against the M+x peak due to an isotopic variant of the monoisotopic peak provides a measure of the isotopic enrichment or depletion of the specific fragment causing the peaks. For +1 variants, the computed ratio may be M0/M+1, M+1/M0 or any other quantity associated with or derived from such a ratio. The intensity ratio M0/M+1 (and, of course, its inverse M+1/M0) will depend on the probability that the +1 Da isotopes that were part of the full molecular ion were transferred to the fragment ion. Generally speaking, this ratio (M0/M+1) will be larger for smaller fragment ions, as small subsets of atoms from the molecule have smaller chances of inheriting the heavy rare isotope. Thus, peak intensity ratios may contain a wealth of information about the structure of the molecule and its fragment ions.

Preferably, the at least one isotopic variant of the monoisotopic molecular ion is a heavy isotopologue. Optionally, at least one isotopic variant has a nominal mass of M+x, wherein M is the mass of the monoisotopic ion and x is an integer (1, 2, 3, . . . ). At least one isotopic variant of the monoisotopic ion may have a nominal mass of M+x and at least one isotopic variant has a nominal mass of M+y, wherein y is an integer (1, 2, 3, . . . ) and y>x, preferably wherein y=x+1. In this way, at least two heavy isotopic variants of the monoisotopic ion of different nominal mass are mass selected simultaneously and fragmented simultaneously. This may enable, for example, focused targeting of the M+1 and M+2 peaks, which are particularly important peaks in many organic molecules. In this way, an isotopic profile for the molecule may be determined for M+1 and M+2 isotopes in a single experimental run.

Preferably, at least one isotopic variant is selected from $^{2}H$, $^{13}C$, $^{14}C$, $^{15}N$, $^{17}O$, $^{18}O$, $^{33}S$, $^{34}S$, $^{37}Cl$ and $^{81}Br$. Advantageously, these isotopes are commonly found in many organic molecules leading to a large number of organic molecules having +1 or +2 isotopologues. Thus, focusing the mass window on these specific isotopes may enable accurate and efficient analysis of a large number of organic and naturally-occurring substances.

Optionally, at least one isotopic variant comprises a clumped isotope (any combination of two or more rare or heavy isotopes in the same molecule). Thus, heavy isotopes that are present together with other heavy isotopes may be analysed. Clumped isotopes are of general scientific interest, but especially in paleoclimatological and atmospheric studies where clumped isotopes are particularly prevalent.

Preferably, determining the isotopic profile comprises associating each data value in the isotopic profile with a mass value for a fragment ion. In other words, each data value (e.g. each peak intensity ratio) may be associated with a particular fragment mass, providing a unique profile for the substance indicative of the isotopic enrichment or depletion of the various fragments that are obtained from the substance. A data structure comprising mass values and associated peak intensity ratios may serve as a unique identifier for a substance.

Optionally, the isotopic profile comprises an isotopic positional distribution. Advantageously, inferring molecular positions associated with each fragment ion may enable a site-specific isotopic content to be determined for a molecule directly from a mass spectrometry system, avoiding the need to analyse samples using NMR. Knowledge of positional isotopic distributions may be particularly advantageous for mechanistic chemistry, since many chemical reactions are known to have rates that are mass-dependent and thus dependent on isotopic enrichment. Therefore, information about a sample's intramolecular isotopic distribution may be used to infer details of the sample's synthesis.

Determining the isotopic positional distribution may comprise associating each data value with a moiety of the molecule. Thus, where a particular site in a molecule does not fragment completely, it is still possible to identify an average isotopic content throughout a particular moiety. Where two (or more) fragments of a known molecule are known to comprise common atom(s) in the molecule, the isotopic content of the common atoms may be determined by averaging the isotopic content of the fragments that share the common atom(s). Thus, even if a specific atom cannot be targeted by fragmentation, if the atom is common to several different fragments of the molecule then an atomic isotopic content may still be determined as a function of the isotopic content of the moieties that comprise the atom.

Optionally, associating each data value with a moiety in the molecule comprises determining moieties of the molecule that correspond to moieties of the fragment ions. Advantageously, this process may be automated using fragmentation libraries that use quantum chemical and/or heuristic models to predict the fragmentation pathways of molecules.

Preferably, the method further comprises comparing the at least one data value in the isotopic profile with at least one corresponding data value of an isotopic profile of a reference sample of the molecule. In other words, this may comprise comparing the intensity ratio M0/M+x for one or more fragment ions to the intensity ratio M0/M+x of the corresponding fragment ion in a reference sample of the molecule and determining from the comparison a distribution of at least one heavy isotope in the molecule in the sample relative to the distribution of the at least one heavy isotope in the molecule in the reference sample. Thus, data values may be normalised using widely available standard samples. Additionally, the use of widely available reference materials may be useful in calibrating mass spectrometry systems that implement the methods of the present disclosure.

In preferred embodiments, the mass window is centred on a mass for the isotopic variant of the monoisotopic molecular ion. This is preferable where the mass window isolates substantially one nominal mass (e.g. where the window is at most 1 Da wide). In cases where the mass window is wider and isolates isotopic variants of the molecular ion having two or more nominal masses, the mass window is preferably centred mid-way between the lowest and highest nominal masses isolated (e.g. mid-way between M+1 and M+2 where the M1 and M2 isotopic variants of the monoisotopic molecular ion are being isolated). Thus, the probability of interference from unwanted isotopologues or adducts may be reduced, leading to improved accuracy of data acquisition.

In aspects of the disclosure, the molecular ion may be a fragment ion. In other words, in some aspects of the present disclosure it is particularly advantageous to set the mass window to isolate the M+x (where x=1, 2, 3, . . . ) value of a fragment ion of the molecule, rather than the molecular ion of the substance. There are instances where it is particularly advantageous to implement secondary fragmentation (or even further rounds of fragmentation) of an ion that is itself a fragment formed in the ion source. Extremely detailed isotopic profiles for molecules may be obtained by performing multiple stages of fragmentations. In some such embodiments, the mass spectrometer may comprise at least two mass selectors or mass filters, and optionally at least two fragmentation devices. An example of a suitable mass spectrometer is the Thermo Scientific™ Orbitrap Fusion™ Tribrid™ Mass Spectrometer. This instrument combines a quadrupole mass filter, fragmentation cell and a mass selective ion trap, as well as an orbital trapping mass analyser. Mass selection (of isotopic variants) of fragment ions and fragmentation of the selected fragment ions may be performed thereby.

In preferred in embodiments, the mass window has a width that is less than 2 Daltons or less than 1 Dalton. Such a mass window advantageously enables the specific rare isotopes common to organic molecules to be investigated. The common, stable isotopes of carbon, hydrogen, nitrogen, oxygen and sulphur would typically be selected by such mass windows. Of course, if triply substituted or heavier isotopes are of interest, then a mass window encompassing values M+x (where x is any positive integer) may be used.

Advantageously, setting the mass window to be no wider than 1 Dalton ensures that relatively few ions are transferred for the monoisotopic peak of the full molecular ion (M0) or the doubly substituted peaks (M+2). Due to the elimination of heavier ions (i.e., those containing adducted H and/or additional heavy isotope substitutions), fragmentation spectra contain fewer peaks, simplifying analysis. Tandem mass spectrometry generally decreases signals from contaminant peaks faster than signals from target analytes due to ion selection, thereby resulting in better signal-to-noise ratios. Advantageously, setting the mass window to be less than 1 Dalton may help with eliminating unwanted background ions from the analysis.

In some embodiments of the disclosure, the method comprises performing mass analysis at a resolution of less than 20000, or less than 15000. At relatively low resolutions such as these, the majority of M+1 peaks in a mass spectrum will register as a single peak. Advantageously, this may enable quick determination of an isotopic profile for a molecule that may still be used to accurately identify the source of the molecule.

In preferred embodiments, the method comprises performing high-resolution mass analysis at a resolution of at least 50000. Preferably, the resolution may be at least 100000. The mass resolution may additionally be at least 240000. Advantageously, the use of high-resolution mass spectrometry may enable information contained within isotopic fine structure to be exploited when determining isotopic profiles for molecules. For instance, resolving isobars in the mass spectrum enables profiles of multiple isotopic variants to be mapped throughout a molecule. For example it becomes possible to derive a $^{13}C$ profile and a $^{2}H$ profile for the same molecule from a single high-resolution mass spectrum. Thus, a vast range of information about the isotopic content of a substance may be derived from a single experiment.

Optionally, the methods of the present disclosure comprise determining a resolution for the mass analysis as a function of mass differences between isotopologues in the molecule. Thus, a mass spectrometer may be operable to adjust the mass resolution dynamically so as to ensure that a desired error or signal quality is obtained, or to specifically target isotopes of a particular element.

Optionally, the method comprises performing mass selection using one or more of a quadrupole mass filter, mass selective RF ion trap, magnetic sector, time-of-flight device, or a Wien filter. Optionally, the method comprises performing mass analysis using one or more of an orbital trapping mass analyser, a quadrupole mass analyser, a time-of-flight mass analyser, an ion trap mass analyser having an RF trap (e.g. a linear RF ion trap or 3D RF ion trap) or an electrostatic trap (such as a Cassini trap for example), a Fourier-transform ion cyclotron resonance mass analyser, and a magnetic sector mass analyser. Optionally, the method comprises fragmenting the mass selected ions by performing one or more of collision-induced dissociation, ultraviolet photodissociation, infrared multiphoton dissociation, electron-transfer dissociation, and electron-capture dissociation. The methods of the present disclosure may be implemented on any suitable combination of known mass analysers, mass selectors and traps.

The method may comprise generating ions of the molecule by electrospray ionisation or electron ionisation (EI, otherwise known as electron impact ionisation or electron bombardment ionisation). Appropriate methods for generating ions may be selected depending on the characteristics of the analyte. The fragmentation patterns of the analyte may differ depending on the method of ionisation employed, thereby allowing the isotopic content of different moieties to be probed using different ionisation methods.

Fragmenting the mass selected ions may comprise subjecting the mass selected ions to collisional energies of: up to 500 eV (i.e. up to and including 500 eV, or alternatively less than 500 eV); up to 100 eV (i.e. up to and including 100 eV, or alternatively less than 100 eV); from 10 to 70 eV (i.e. greater than 10 eV and less than 70 eV, or alternatively from 10 eV to 70 eV including the values 10 eV and 70 eV); from 10 to 30 eV (i.e. greater than 10 eV and less than 30 eV, or alternatively from 10 eV to 30 eV including the values 10 eV and 30 eV); or alternatively from 50 to 70 eV (i.e. greater than 50 eV and less than 70 eV, or alternatively from 50 eV to 70 eV including the values 50 eV and 70 eV). The fragmentation energy be selected according to the resistance of the analyte to fragmentation. For instance, higher collisional energies may be employed for analytes that do not readily fragment.

In a further aspect of the present disclosure, there is provided a computer program, configured when operated by a processor to cause a mass spectrometry system to carry out the methods described herein. The methods of the present disclosure may be automated entirely, enabling easy analysis of substances and reducing the burden on instrument operators.

A mass spectrometry system is also provided that is configured to carry out any of the methods described herein.

In a further aspect of the disclosure, a method for identifying a sample is provided, the method comprising: determining an isotopic profile for the sample, the isotopic profile indicative of an isotopic content for the sample, the method comprising: mass selecting ions of the sample in a mass window, the mass window excluding a mass for a monoisotopic molecular ion and including a mass for at least one isotopic variant of the monoisotopic molecular ion; fragmenting the mass selected ions into fragment ions; performing mass analysis on one or more of the fragment ions to produce a mass spectrum; and determining the isotopic profile for the sample, the isotopic profile comprising at least one data value, each data value associated with a fragment ion and calculated as a function of intensities of multiple peaks in the mass spectrum; determining a similarity measure between the determined isotopic profile and an isotopic profile in a data store; and identifying the sample as corresponding with a record in the data store when the similarity measure satisfies a threshold condition. Thus, unknown samples may be analysed and compared with records of previously analysed samples so as to obtain information about the source of the sample. One or more matches may be returned to a user when it is identified that a sample corresponds or has similar properties to other characterised samples of the substance.

These principles of instrument operation and data analysis are of general applicability throughout the specific worked examples that follow.

SPECIFIC EXAMPLES

Figure 3A:
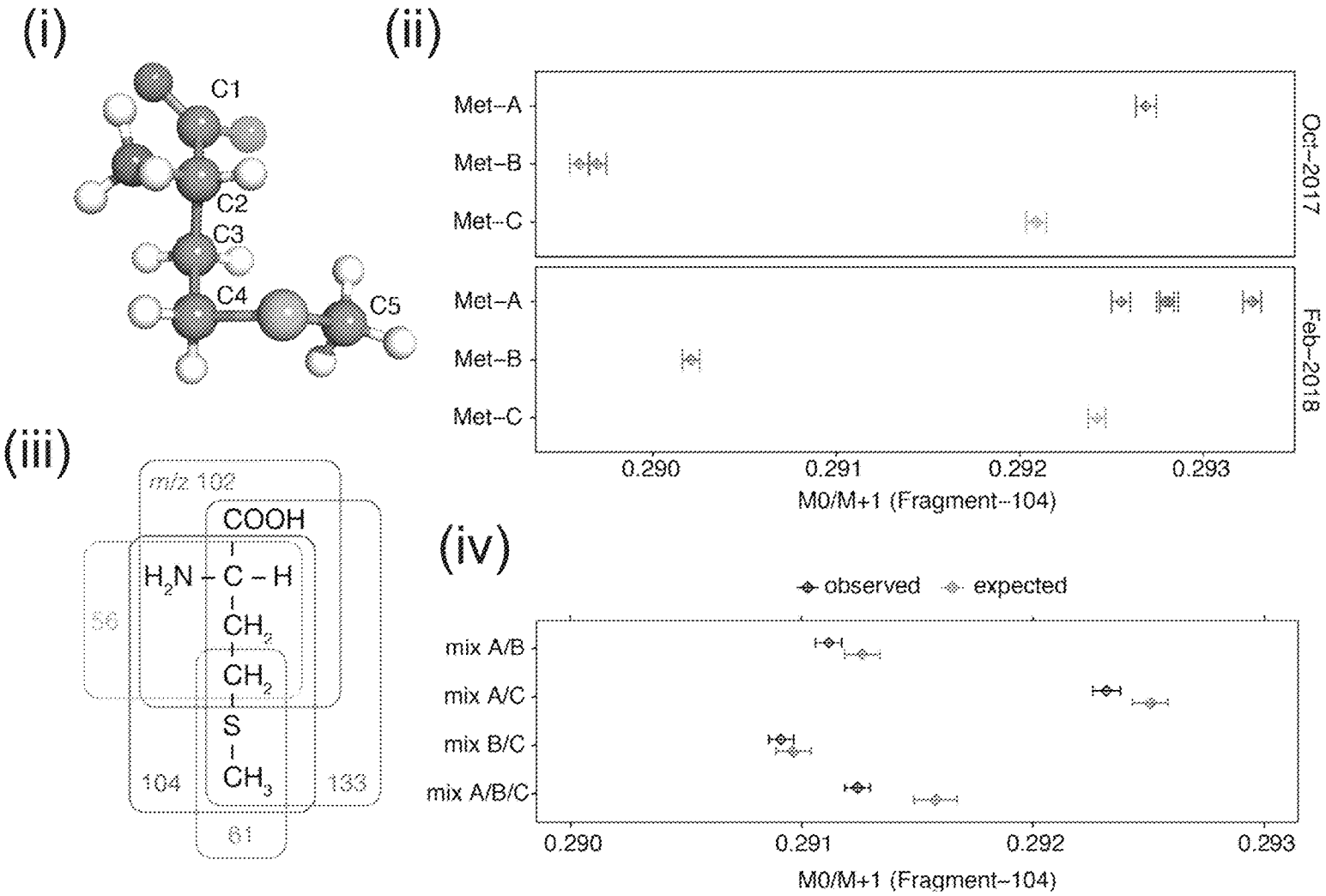
FIG. 3*a* shows a structure and empirical results for methionine (Met) from different sources exhibiting distinct intramolecular isotope distributions when analysed using embodiments of the present disclosure.

Referring now to FIG. 3*a*, there is depicted an illustrative example of the methods of the present disclosure. The disclosed methods are demonstrated by analysis of Methionine (Met), which may be introduced into a mass spectrometer by direct infusion of a solution. Met ionises primarily as a $[M+H]^+$ molecular ion with a nominal mass of m/z 150 by electrospray ionisation. Its relatively low molecular weight allows resolution of nearly all isobaric M+1 isotopologues of the molecular and fragment ions with current Orbitrap™ mass analysers at R>100000. The MS/MS fragmentation spectrum of Met contains several singly-charged peaks greater than m/z 50, which is a low mass cut-off in the Q Exactive™ mass spectrometer. It will be appreciated that many multiply-charged peaks are below the low-mass cut-off, which simplifies the illustration and analysis of the mass spectra of the present disclosure. Thus, Met is an ideal material for demonstrating the benefits provided by the methods of the present disclosure, although it is to be noted that the disclosed techniques are generally applicable to similarly sized organic molecules.

Low-resolution measurements of Met demonstrate that $^{13}C$ variations tend to dominate M0/M+1 ratio variations, because $^{13}C$ is the most abundant +1 Da isotope in Met. Additionally, high-resolution measurements reveal a large family of M0/M+1 ratio variations due to differences between samples in site-specific $^{13}C$, $^{15}N$, $^{33}S$, $^{2}H$ and $^{17}O$ variations. Analysis of investigations into seven commercially available Met samples are presented herein, six of which (Met-A, Met-B, Met-C, Met-D, Met-G, Met-H) were chemically synthesised and one (Met-E) of which was described as being derived from a synthetic source but which displays properties that suggest it may be derived from processed ewe's milk†. A full specification of the materials that are described herein is depicted in Table 1 below and site-specific isotope ratios determined for certain samples using methods of the present disclosure are depicted in Table 2.

TABLE 1

Met sources used, including bulk isotopic composition (±SD).

| | Met-A | Met-B | Met-C | Met-D |
|---|---|---|---|---|
| Origin | Synthetic | Synthetic | Synthetic | Synthetic |
| Material | Organic L-Methionine | L-Methionine | DL-Methionine | Organic L-Methionine |
| Supplier | Sigma | Sigma | Sigma | Sigma |
| Quality | from non-animal source, suitable for | BioUltra, >=99.5% NT | ≥99% | reagent grade, ≥98% (HPLC) |
| Catalog No | M5308 | 64319 | M9500 | M9625 |
| Batch | 066K0154 | BCBH2413V | 106H0847 | 074K0372 |
| $\delta^{13}C$ (‰) | −30.0 ± 0.1 | −31.9 ± 0.1 | −29.3 ± 0.12 | −27.9 ± 0.1 |
| $\delta^{34}S$ (‰) | 4.3 ± 0.4 | 6.3 ± 0.3 | −6.1 ± 0.3 | −4.9 ± 0.3 |

TABLE 1-continued

Met sources used, including bulk isotopic composition (±SD).

| | Met-A | Met-B | Met-C | Met-D |
|---|---|---|---|---|
| | Met-E†,‡ | Met-G‡ | | Met-H‡ |
| Origin | Synthetic | Synthetic | | Synthetic |
| Material | L-Methionine | L-Methionine | | DL-Methionine |
| Supplier | MP Biomedicals | Sigma | | Sigma |
| Quality | — | BioUltra > 99% | | >99% |
| Catalog No. | 2194707 | 64319-25G-F | | M-9500 |
| Batch | Q4314 | BCBJ3757V | | 105H0017 |
| $\delta^{13}C$ (‰) | −34.8* | −31.5* | | −25.7* |
| $\delta^{34}S$ (‰) | — | — | | — |

TABLE 2

Site-specific isotope ratios.

| Site-specific $\delta^{13}C$(‰) | | Met-A | Met-B | Met-C | Met-D |
|---|---|---|---|---|---|
| C1 | NMR | — | — | — | — |
| | MS/MS | −24.3 (−23.4) | | | −23.9 |
| | Ninhydrin | | | | |
| C2 | NMR | — | — | — | — |
| | MS/MS** | −24.0 (−25.2) | | | −22.9 |
| C3 | NMR | — | — | — | — |
| | MS/MS** | −24.0 (−25.2) | | | −22.9 |
| C4 | NMR | — | — | — | — |
| | MS/MS | −23.7 (−22.6) | | | −25.5 |
| C5 | NMR | — | — | — | — |
| | MS/MS | −53.9 (−53.7) | | | −44.4 |

| Site-specific $\delta^{13}C$(‰) | | Met-E†,‡ | Met-G | Met-H‡ |
|---|---|---|---|---|
| C1 | NMR | −36.7 (−37.5#) / | −32.3 | −21.4 |
| | MS/MS | −39.0 (−38.0) | −32.1 (−31.4) | |
| | Ninhydrin | −45.5 | −40.9 | |
| C2 | NMR | −37.6 (−40.6)/ | −27.6 | −27.3 |
| | MS/MS** | −28.4 (−29.1) | −25.1 (−26.3) | |
| C3 | NMR | −24.8 (−23.4) | −22.8 | −12.8 |
| | MS/MS** | −28.4/−29.1 | −25.1 (−26.3) | |
| C4 | NMR | −25.1 (−26.4) | −28.5 | −18.7 |
| | MS/MS | −26.9 (−25.9) | −28.5 (−25.4) | |
| C5 | NMR | −49.8 (−46.1) | −46.7 | −48.4 |
| | MS/MS | −51.3 (−52.1) | −46.5 (−47.7) | |

Repeat preparation

† Met-E is identical to the material from MP Biomedicals used by Romek et al., where it is reported with a different batch number (MR31057). Its certificate of origin states a synthetic origin and that manufacture of this product does not utilize any raw materials that are of animal origin. It is possible, however, that it has been purified from ewe's milk and the origin has later been labelled as 'synthetic' due to processing.

‡ NMR and ninhydrin reaction previously reported by Romek et al.

* Bulk value by irm-EA/MS on free amino acid

** Sites C2 and C3 are not distinguishable by MS/MS, hence represent average values.

Values from an instrumental replicate analysis in brackets.

As the present disclosure returns relatively precise observations of M0/M+1 ratios of several fragment ion peaks, each of which measures a different subset of atomic sites in the parent molecular ion, site-specific isotopic distributions for Met are determined and compared with similar data obtained using other methods. In particular, three of the Met products analysed in this example (Met-E, Met-G, Met-H) have recently been studied by irm-$^{13}$C-NMR to obtain positional $^{13}$C/$^{12}$C ratios. NMR data for two of these (Met-E and Met-H) have been previously been reported (Romek et al, "Insights into the role of methionine synthase in the universal $^{13}$C depletion in O- and N-methyl groups of natural products", Arch. Biochem. Biophys., 2017, 635, 60-65). Thus, it is possible to compare results obtained using the methods of the present disclosure with existing analytical methods.

For simplicity, Met-A is taken to be an internal reference standard in comparisons between materials in these specific examples. However, it will be appreciated that data may be normalised relative to other reference standards.

Referring now to FIG. 3*a*(i), there is shown the chemical structure of Met, with carbon environments labelled as C1 (in the carboxylate group), increasing consecutively through to C5 (the methyl group that is bonded to sulphur at the end distal from the carboxylate group). In FIG. 3*a*(ii) there are shown M0/M+1 ratios for three different sources of Met (Met-A, Met-B and Met-C), for the fragment having a peak at a mass of 104 in measurements taken in October 2017 (Oct-2017) and February 2018 (Feb-2018). In FIG. 3*a*(iii) there is shown a mapping between moieties in Met together with masses of fragments related to the moieties. Then, in FIG. 3*a*(iv) there are shown M0/M+1 values for mixtures of different combinations of Met.

The reproducibility of the measurement of M0/M+1 ratios using Met-A, Met-B and Met-C is demonstrated in FIG. 3*a*(ii). These three chemically synthesised Met samples can be distinguished by their M0/M+1 ratios. This is shown for Fragment-104, which is generated by loss of carbon C1 via decarboxylation. It can be seen that on the first date of data collection (October-2017) the peak intensity ratio for Met-A differed from that of Met-B by 58 times the standard error of the mean (SEM) and from Met-C by 11 SEM. The difference between Met-B and an independently prepared solution of the same material was small (<2 SEM).

When the analysis was repeated in February-2018, similar differences between the three materials were observed. Specifically, Met-A differed from Met-B (on average) by 54 SEM and from Met-C by 9 SEM. On this day, Met-A was analysed four times, using a fresh solution and repeated infusions of the same sample up to 6 hours apart. The individual M0/M+1 of Fragment-104 for these runs revealed larger variability (up to 7 SEM). Overall, M0/M+1 values are shifted slightly between the two dates of data collection and were slightly higher than the earlier measurements, but the relative differences between the three materials were clearly reproducible. For instance, the exact mass of Met-A differed from that of Met-B on average by 0.003004 in October-2017 and 0.00308 in February-2018. Thus, the different sources of Met each have characteristic M0/M+1 values that are sufficiently stable over time, even when samples are prepared and measured several months apart.

On a single day, differences in obtained values can be seen to occur between replicates, especially when the samples are analysed several hours apart. For instance, a degree of variability can be seen in the measurements of Met-A in February-2018 in FIG. 3*a*(ii). Thus, in certain embodiments of the present disclosure it may be advantageous to collect data in a way that can be used to correct for such shifting ratios. This can be achieved by, for example, alternating ionisation between a sample and a reference standard. Other suitable methods for performing such corrections will be readily appreciated by those skilled in the art. Thus, these measurements surprisingly demonstrate an ability to differentiate between samples in a reproducible manner.

The linearity and accuracy of these measurements is demonstrated in FIG. 3*a*(iv) using four equimolar mixtures of Met-A, Met-B and Met-C: mix-A/B, mix-B/C, mix-A/C and mix-A/B/C. The methods can be seen to provide a linear measure of differences in site-specific isotopic distributions, since mixtures of end members are analysed and demonstrated to have compositions intermediate between those end members in the measured peak intensity ratios. This is largely true within the limits of the precision of the measurements and weighing errors in sample preparation. The minor discrepancies between some of the expected and observed ratios may arise due to the fact that isotopic indices involving some isotopologues may exhbit subtle non-linearities, as previously explored for clumped isotope species (J. M. Eiler, "The isotopic anatomies of molecules and minerals", Annu. Rev. Earth Planet. Sci. 41 (2013) 411-441). Nevertheless, such differences are minor and do not detract significantly from the capability of the disclosed methods to discriminate between materials from different sources.

As depicted in FIG. 3*a*(iv), the measured M0/M+1 ratios of all four mixtures are between those measured for the end members and close to the expected values. These and analogous comparisons from all fragments and Met materials that were quantified at low and high-resolution (such as additional data shown in FIGS. 4, 5*a* and 5*b*) demonstrate that isotopic differences between materials can be resolved with a surprising degree of reproducibility and relative accuracy, thus suggesting novel applications in a variety of fields.

Figure 3B:
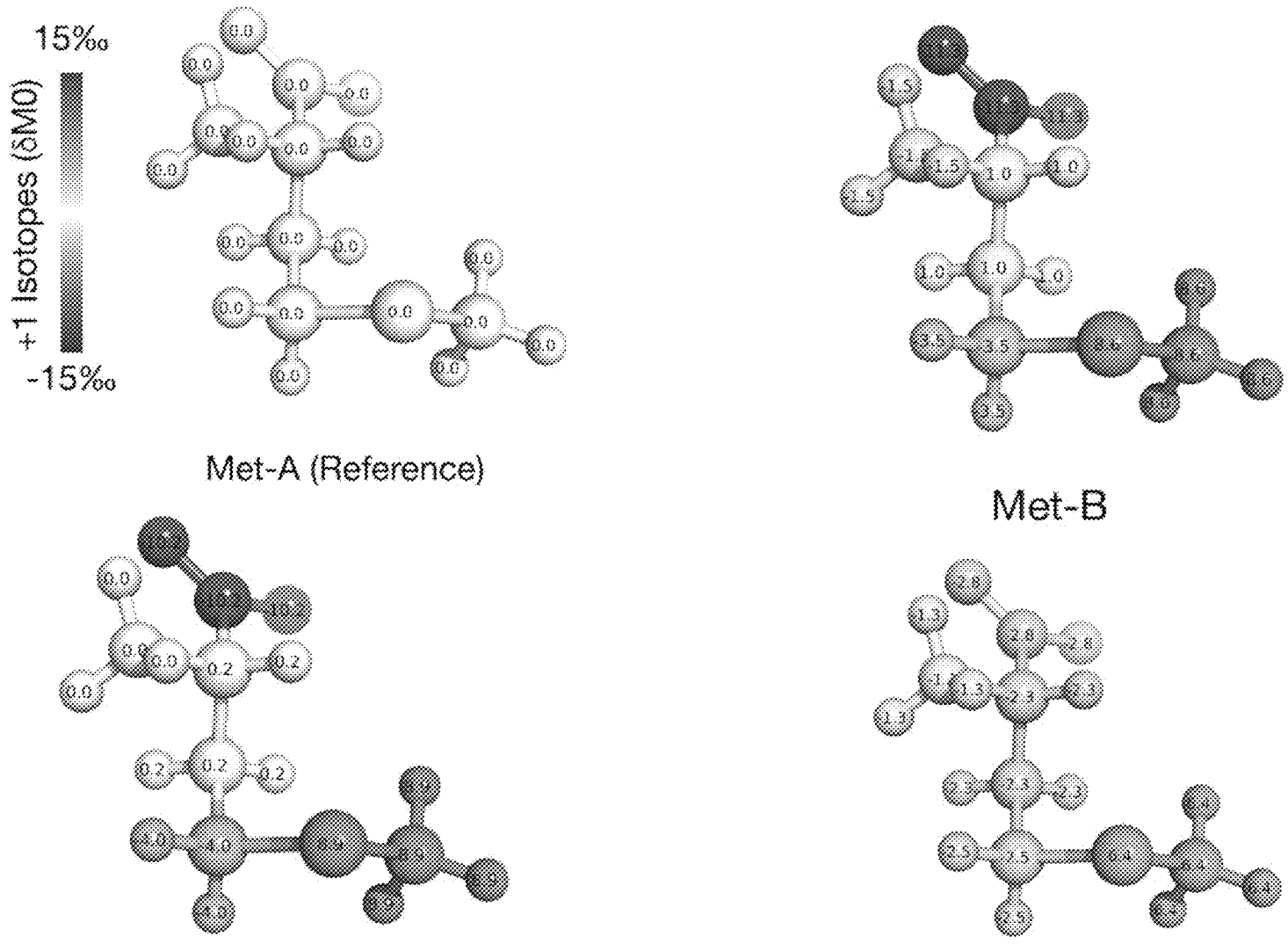
FIG. 3*b* shows isotopic positional distributions for Met determined using embodiments of the present disclosure.

Referring next to FIG. 3*b*, there are shown isotopic profiles for four samples of Met. Such positional distributions of isotopes may be obtained by associating peak groups in a mass spectrum with molecular moieties. Thus, an isotopic profile indicating the relative enrichment or depletion of a substance at different molecular sites may be determined using the methods of the present disclosure.

The relationships between the five fragments of FIG. 3*a*(iii) (having monoisotopic masses 56, 61, 102, 104 and 133) and molecular positions may be used to infer isotopic content of a molecule as a function of position in the molecule. The samples illustrated in FIG. 3*b* are Met-A, which is a reference sample against which all isotopic abundance are compared, Met-B, a replicate sample of Met-B, and Met-C. The enrichment or depletion of +1 isotopes is illustrated at each resolvable position in each Met sample. As Met-A is taken as the reference value for these measurements, Met-A has (by definition) an enrichment of 0.0 at each molecular position.

As can be seen in FIG. 3*b*, Met-B and Met-B (replicate) exhibit relative depletion (−11.3% and −10.2%) of +1 isotopes at the carboxylate moiety, whilst the moiety comprising sulphur and the C5 methyl group is relatively enriched in +1 isotopes (+8.6% and +8.9%). These values are consistent between samples of Met-B and clearly demonstrate a distinct intramolecular isotopic distribution for Met-B compared to that of Met-A. Similarly, Met-C exhibits an intramolecular isotopic distribution amongst its molecular sites that distinguishes Met-C from both Met-A and both Met-B samples.

The results indicate that Met-B is depleted at C1 relative to Met-A and Met-C. Overall, Met-B and Met-C Met are more similar to each other than to the reference Met-A. A common feature between Met-B and Met-C is their isotopic enrichment in the terminal region that contains the methyl group (C5). Together, these differences illustrate on a structural basis how the M+1 ions from these three chemically synthesised Met samples vary in their intramolecular isotope distribution. Mapping of isotope variations onto structures, as performed here based on ESI-MS/MS data, is useful to assist studies into how these patterns of isotopic heterogeneity form. Thus, the methods of the present disclosure provide rich structural information that may be used to profile the source and synthesis pathways of molecules.

Figure 4:
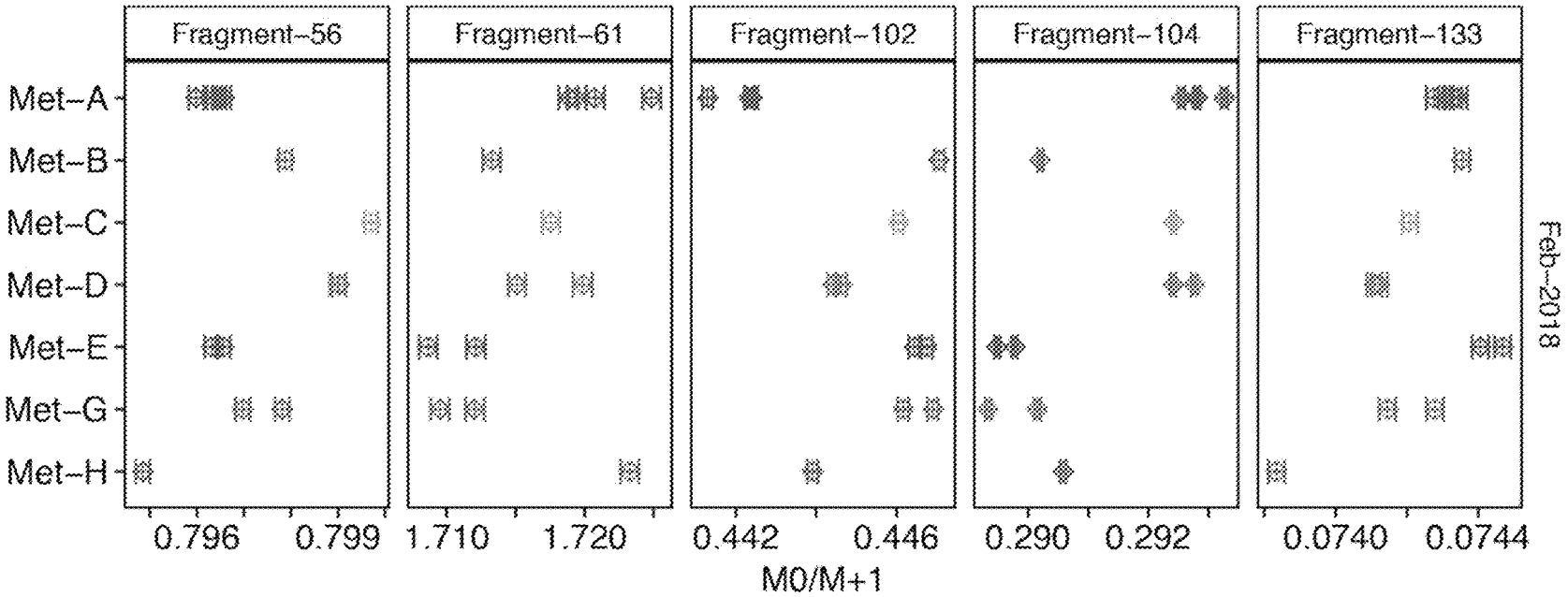
FIG. 4 shows a low-resolution set of data values obtained using embodiments of the present disclosure.

In FIG. 4 there is depicted an isotopic profile comprising a set of data values derived from low-resolution mass spectrometry, in which M0/M+1 peak intensity ratios are depicted for each of the five fragments of Met depicted in FIG. 3*a*(iii). These ratios are calculated for the seven samples of Met described in the present disclosure: Met-A, Met-B, Met-C, Met-D, Met-E, Met-G and Met-H. As the mass spectrometry for this data was collected at low-resolution, the M+1 peak from each fragment represents a total contribution from +1 isotopes, since nearly isobaric peaks that differ only by virtue of containing different +1 isotopes are not resolvable. As shown in FIG. 4, the error bars for each M0/M+1 ratio for each material are relatively small in comparison with the variations in M0/M+1 across the various samples. Thus, this low-resolution data provides a useful isotopic profile of a molecule that may be used to distinguish between samples reliably and consistently.

It will be appreciated that whilst in some embodiments of the disclosure, it may be beneficial to derive isotopic positional distributions such as those depicted in FIG. 3*b*, the set of data values depicted in FIG. 4 (or similar) is highly advantageous in its own right. As demonstrated throughout the present disclosure, data structures derived from substances that comprise fragment masses and associated peak intensity ratios (or values derived therefrom) may effectively serve as an isotopic profile for the substance that may be used to identify and the substance reliably. Thus, whilst further benefits in visualisation and quantitative analysis may arise from associating fragments with particular molecular sites, these are complementary to the set of data values shown in FIG. 4, which provide a unique identifier for a substance.

Figure 5A:
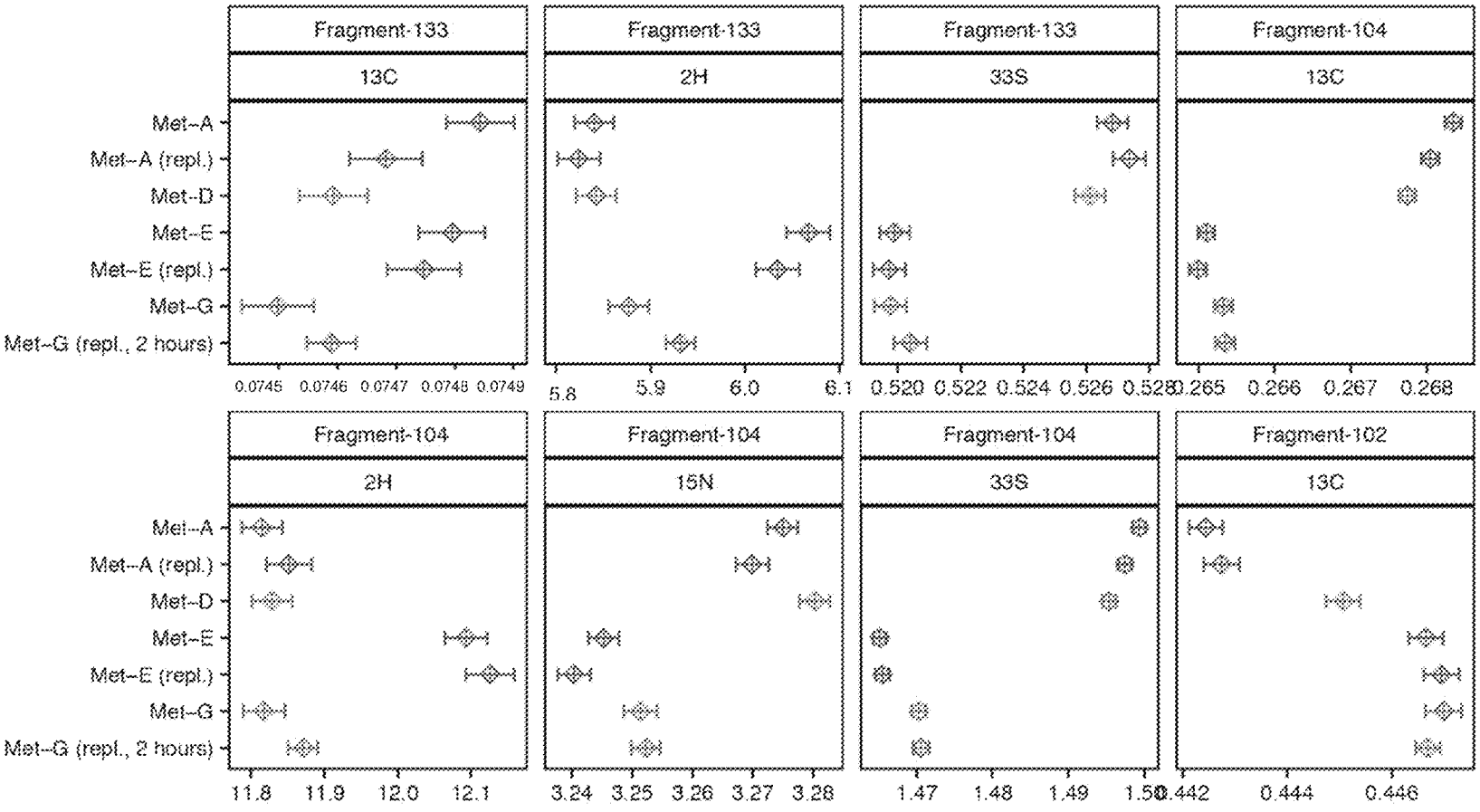
FIG. 5*a* shows high-resolution data comprising M0/M+1 ratios for fragments and isotopes of Met, as determined in accordance with embodiments of the present disclosure.
Figure 5B:
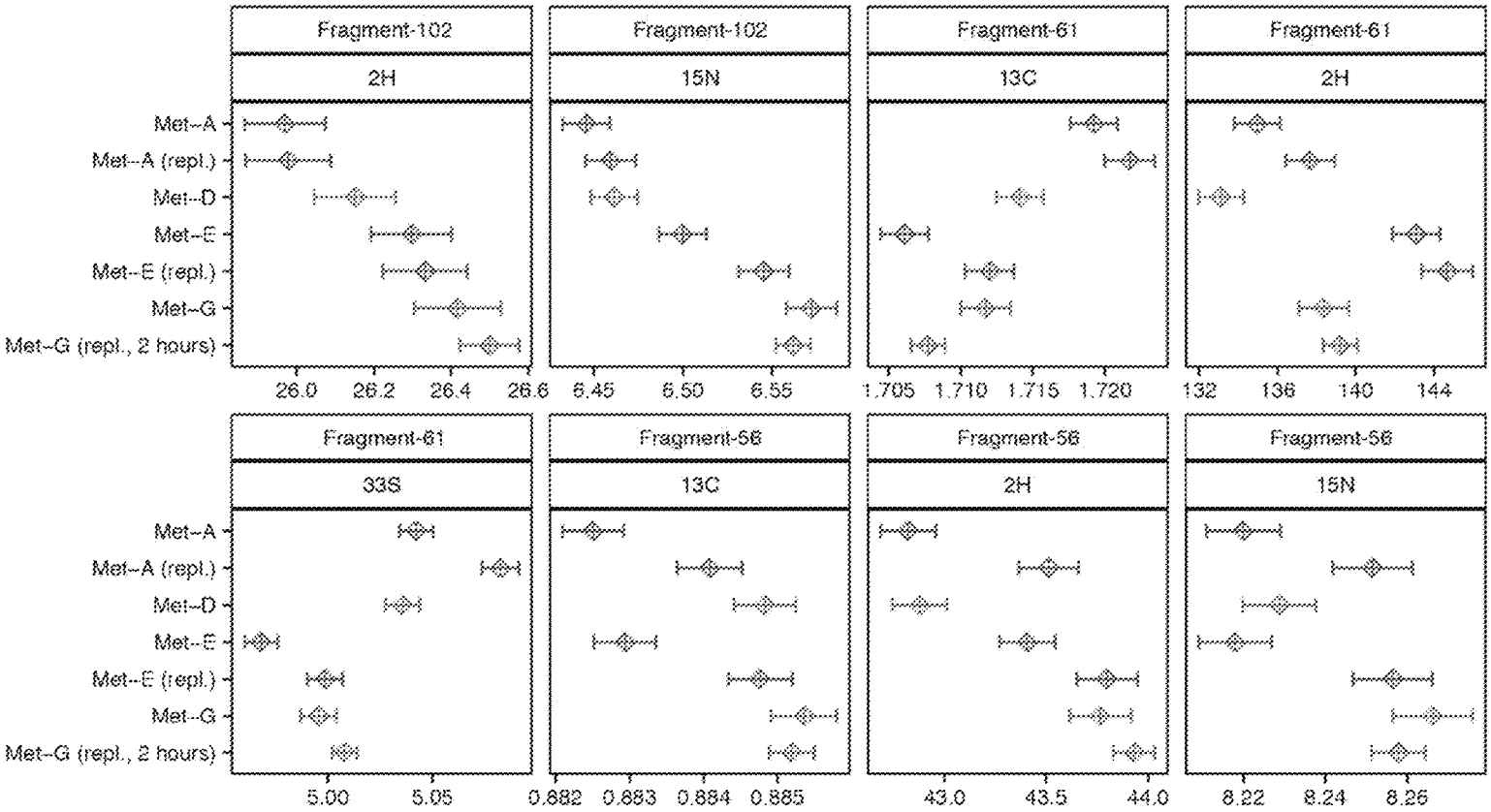
FIG. 5*b* shows high-resolution data comprising M0/M+1 ratios for fragments and isotopes of Met, as determined in accordance with embodiments of the present disclosure.

Referring next to FIGS. 5*a* and 5*b*, there is depicted a high-resolution set of data values showing M0/M+1 ratios for all fragments and isotopes of Met, for seven Met source samples: Met-A, Met-a (replicate), Met-D, Met-E, Met-E (replicate), Met-G and Met-G (replicate). As can be seen, the use of high-resolution mass spectrometry enables fragment-specific isotope ratios for each isotopologue of Met to be determined. Such data may be stored as isotopic fragments and associated peak intensity ratios for each isotopic variant (i.e. $^{13}C$, $^{2}H$, $^{33}S$, $^{15}N$) of Methionine. Additionally or alternatively the data may be associated with molecular positions rather than fragment masses, analogously to how the data of FIG. 4 may be associated with molecular moieties.

It is evident from the error bars shown in FIGS. 5*a* and 5*b* that the data values (in this case peak intensity ratios) vary amongst the different sources of Met in a way that is reliable and reproducible. Thus, the high-resolution method is shown to be accurate and capable of discriminating different sources of material whilst providing even further detail about the precise isotopic composition of the M+1 peaks. An understanding of the fragmentation scheme of Met means that the data of FIGS. 5*a* and 5*b* may be used to rationalise specific differences in the isotopic composition of Met materials.

Figure 6:
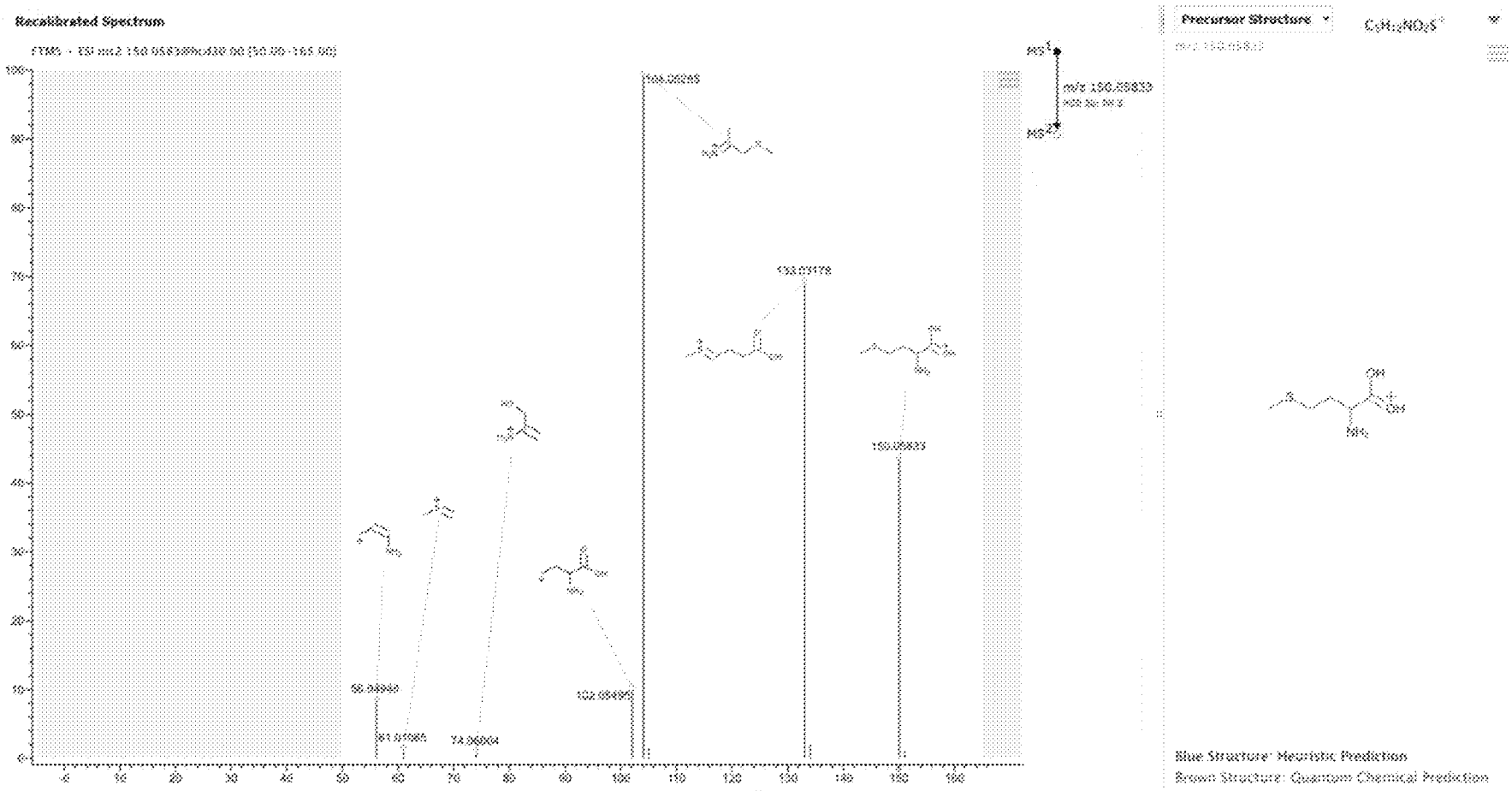
FIG. 6 shows a predicted fragmentation of Met.

For instance, referring now to FIG. 6, there is shown a predicted fragmentation scheme for Met. Such a fragmentation scheme may be used to automatically associate fragment ions and molecular moieties as described with reference to the set of data values in FIGS. 4 and 5. In FIG. 6 it is shown that the high-resolution masses and isotopic fine structure of Met fragments closely matches the fragmentation pattern predicted by widely available tools, such as www.mzcloud.org. The fragmentation pattern of Met is examined, enabling predictions to be made as to which sites are sampled by which fragment ions.

The data of FIG. 6 may be used to infer the fragment ions that are generated by the mechanisms suggested by the fragmentation prediction algorithms. Notably, identified mechanisms include deamination (Fragment-133), decarboxylation (Fragment-104), cleavage of the C—C bond between C3 and C4 (Fragment-61), cleavage of the C—S bond between C4 and S (Fragment-102), and cleavage of the same C—S bond in addition to decarboxylation (Fragment-56).

This information from the fragmentation scheme assists in recognising specific differences between Met materials. For example, a lower M0/M+1 ratio of the decarboxylated Fragment-104 indicates that the isotopologue that has a $^{13}C$ in the carboxyl group (C1) accounts for a smaller proportion of the M+1 molecular ions. Thus, the fragment composition and measured isotope abundances may be used to compute the abundance of +1 Da isotopes in different molecular sites, noting that atomic positions that are indistinguishable by mass spectrometry may be grouped into one unique site.

The predicted fragmentation scheme of FIG. 6 may be used to map isotopic variations of the predicted fragment ions to the chemical structure of Met by calculating the abundance of M+1 ions (or other isotopic variants, where desired) for the unique sites of the molecule. The N and H atoms of the amino group in Met are typically measured together in low-resolution analysis and are thus considered to form one unique site in an isotopic profile. The peak intensity ratios derived from each Met fragment ion that comprises the N and H site may then be expected to contribute to the isotopic data value determined for the N and H site.

In embodiments of the disclosure, this may be implemented systematically by defining fragments by a matrix F, comprising values 0 and 1 and having dimensions m×n, for the fragments of Met (or any other substance). Each column n in F represents, in turn, one of the six unique sites in the molecular structure for Met: amino group, C2-H, carboxyl group, C3-$H_2$, C4-$H_2$ and S—$CH_3$. Each row m defines a fragment (Fragment-133: deamination, Fragment-104: decarboxylation, Fragment-102: loss of methyl-sulphur, Fragment-61: sulphur-containing fragment). The values 0 and 1 may then indicate the absence or presence of the n-th unique site within the m-th fragment. Matrix F may be populated automatically for various molecules using predicted fragmentation schemes.

Matrix F may be used to define a system of equations that may be expressed in the form F·S=A, as shown in Equation 1. In embodiments of the disclosure, S is a vector having values that each represent the isotopic abundance of a unique site, whilst A is a vector of measured neutron abundances (M+1)/(M0+M+1) derived from a mass spectrum obtained by performing mass analysis.

$$\begin{bmatrix} 0 & 1 & 1 & 1 & 1 \\ 1 & 0 & 1 & 1 & 1 \\ 1 & 1 & 1 & 0 & 0 \\ 0 & 0 & 0 & 1 & 1 \\ 1 & 0 & 1 & 1 & 0 \end{bmatrix} \cdot \begin{bmatrix} \text{amino} \\ \text{carboxyl} \\ (C2 + C3) - H_3 \\ C4 - H_2 \\ \text{S-methyl} \end{bmatrix} = \begin{bmatrix} (M1/(M0+M1)_{Fragment\cdot 133} \\ (M1/(M0+M1)_{Fragment\cdot 104} \\ (M1/(M0+M1)_{Fragment\cdot 102} \\ (M1/(M0+M1)_{Fragment\cdot 61} \\ (M1/(M0+M1)_{Fragment\cdot 56} \end{bmatrix} \quad \text{Equation 1}$$

Expanding the top row of the system of equations in Equation 1 illustrates that the isotopic data value for the amino site in Met may be calculated based on the contributions to peak intensity ratios from each of the fragments of Met that comprise the amino site. In this case, all fragments except the deamination fragment contribute to the isotopic data value for the amino site, as expected.

The abundance of M+1 in Met sites may be computed from this system of equations by minimisation of the relative differences between predicted and observed isotope abundances in fragments, by varying the values in vector S. The abundance of M+1 in Met sites may additionally be constrained such that their sum equals 100%. Suitable linear algebraic techniques for solving such systems of equations will be known to those skilled in the art. Thus, solving the system of equations defined by Equation 1 may enable the calculation of isotopic positional distributions, such as those depicted in FIG. 3*b* for different Met samples. It will be appreciated that additional measurements such as, for example, bulk isotope ratios may be used to provide further constraints on the data values calculated.

Figure 7:
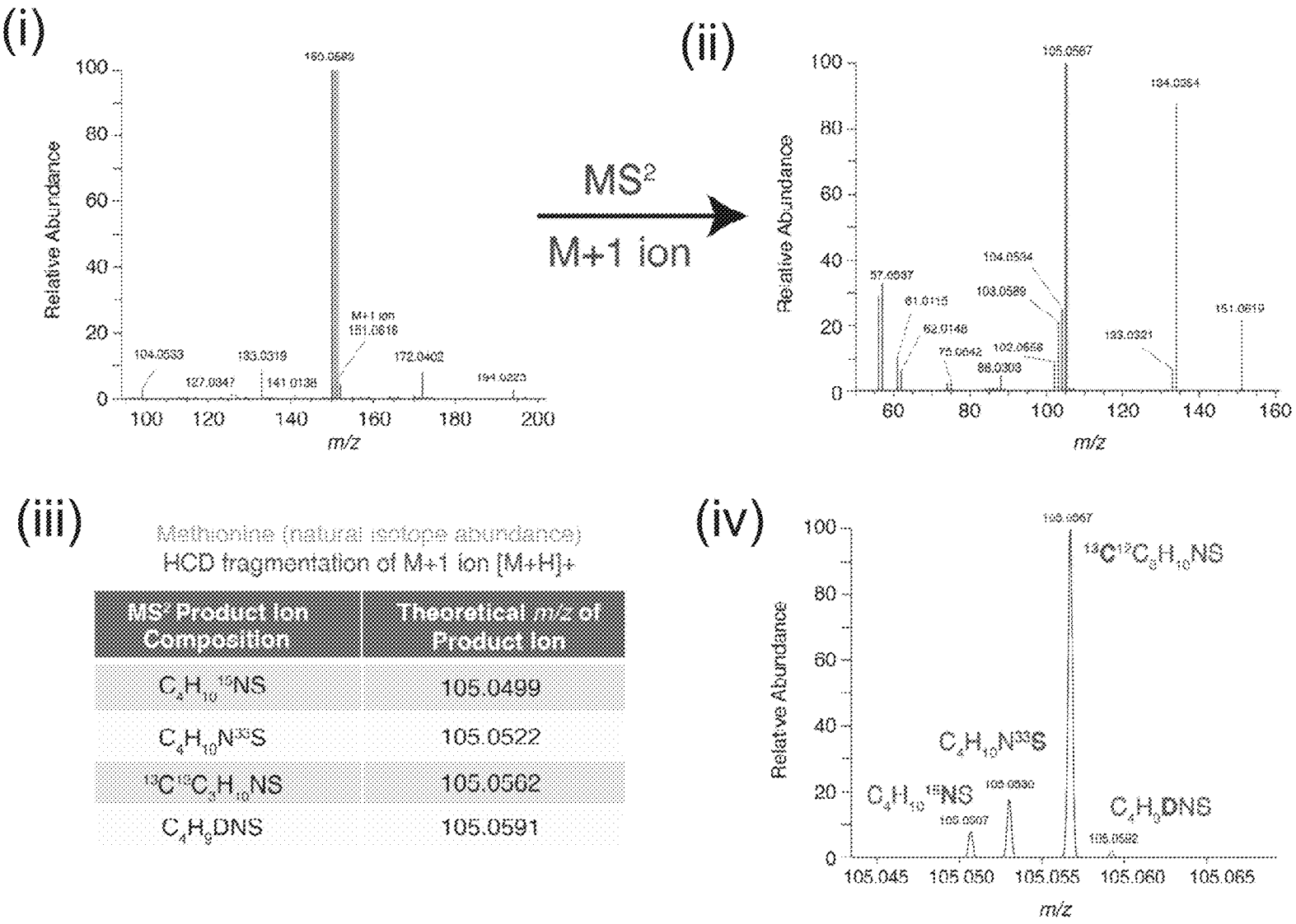
FIG. 7 shows examples of isotopologues resolved by high-resolution MS/M measurements of Met M+1 ions (R=240000)

Referring now to FIG. 7, there is shown an example of a method of resolving isotopologues using high-resolution MS/MS measurement of Met M+1 ions, performed at resolution of 240000. Orbitrap™ mass analysers operated at high-resolution are capable of resolving the contribution of specific elements in M+1 fragment ions and are therefore capable of obtaining highly defined information about isotopic composition.

In FIG. 7(i), there is shown a mass spectrum of Met. In FIG. 7(ii), the M+1 variant of the monoisotopic molecular ion peak is isolated and selected for $MS^2$ analysis, providing a high-resolution mass spectrum of the fragment ions from the M+1 molecular ion. In FIG. 7(iii) there are shown $MS^2$ product ion compositions and theoretical exact masses therefor. FIG. 7(iv) then depicts the high-resolution data of FIG. 7(ii) within a narrower mass range, and shows that from the values of FIG. 7(iii), individual, nearly isobaric peaks in the high-resolution mass spectrum can be resolved and associated with specific isotopic chemical compositions. Thus, the methods of the present disclosure may enable peak intensity ratios to be associated with any one or more of: fragment masses; fragment chemical compositions (including precise information about which isotopologues are present and in which quantities); and positional distributions of isotopes within fragments or molecules.

Figure 8:
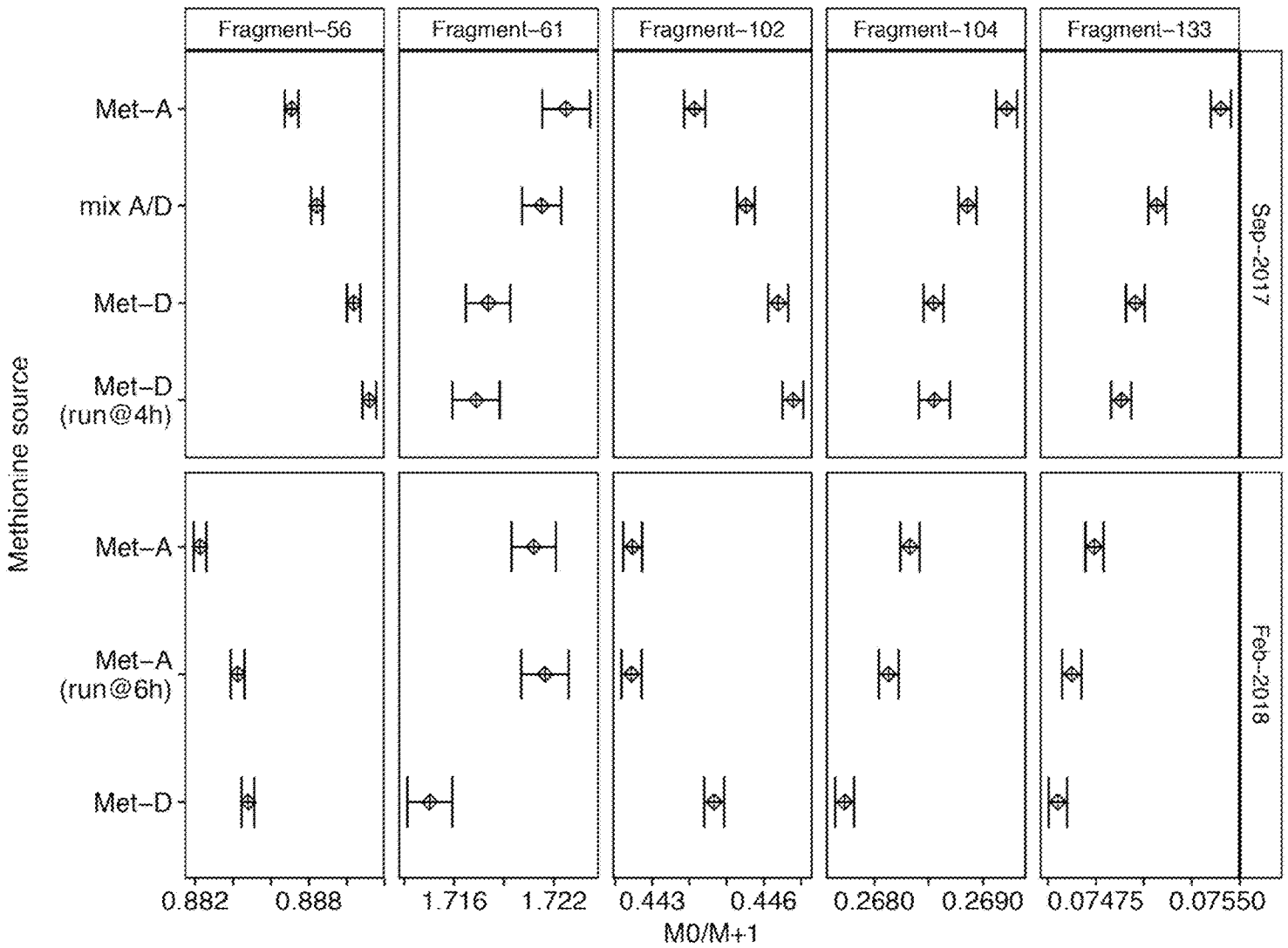
FIG. 8 shows signals in the isotopic fine structure of fragments used to discriminate between different sources of Met.

Referring to FIG. 8, there is shown a set of data values indicating how signals in the isotopic fine structure of fragments may be used to discriminate between sources of Met. In this example, the high-resolution mode is performed using the same instrument settings as described previously except that resolving power is increased and data is collected for a longer period of time. In the present example, the data were collected for 1 hour at a resolution of 240000, which is equivalent to approximately 7000 scans. Measurements taken in September-2017 and February-2018 are depicted in order to demonstrate the long-term stability of the values obtained.

In order to derive the data of FIG. 8, solutions of two commercially available, chemically synthesised products, Met-A and Met-D, an equimolar mixture thereof (mix-A/D) and a repeated infusion of Met-D were each analysed at high-resolution in September-2017. The use of high-resolution instrument settings enables the resolution of many isotopic variants of M+1 peaks ($^{13}C$, $^{2}H$, $^{33}S$, $^{15}N$, with $^{17}O$ not resolved). In FIG. 8, the data shown relates to the M0/M+1 ratio from $^{13}C$ peaks, where the data points represent geometric means and the error bars are ±SEM. These data suggest that in the high-resolution mode of operation, where data collection for certain questions may require infusion of samples for no more than several hours, the relative accuracy of the measurement was sufficient to detect clear and reproducible isotopic differences between Met materials.

In order to test the high-resolution methods of the disclosure in depth, an extensive set of data values from a subset of the Met materials was analysed again. In particular, Met-A and Met-D were analysed again in February-2018, which confirmed long term reproducibility of isotopic differences. Thus, the high-resolution methods of the present disclosure represent accurate and reliable tools for characterising substances.

Figure 9A:
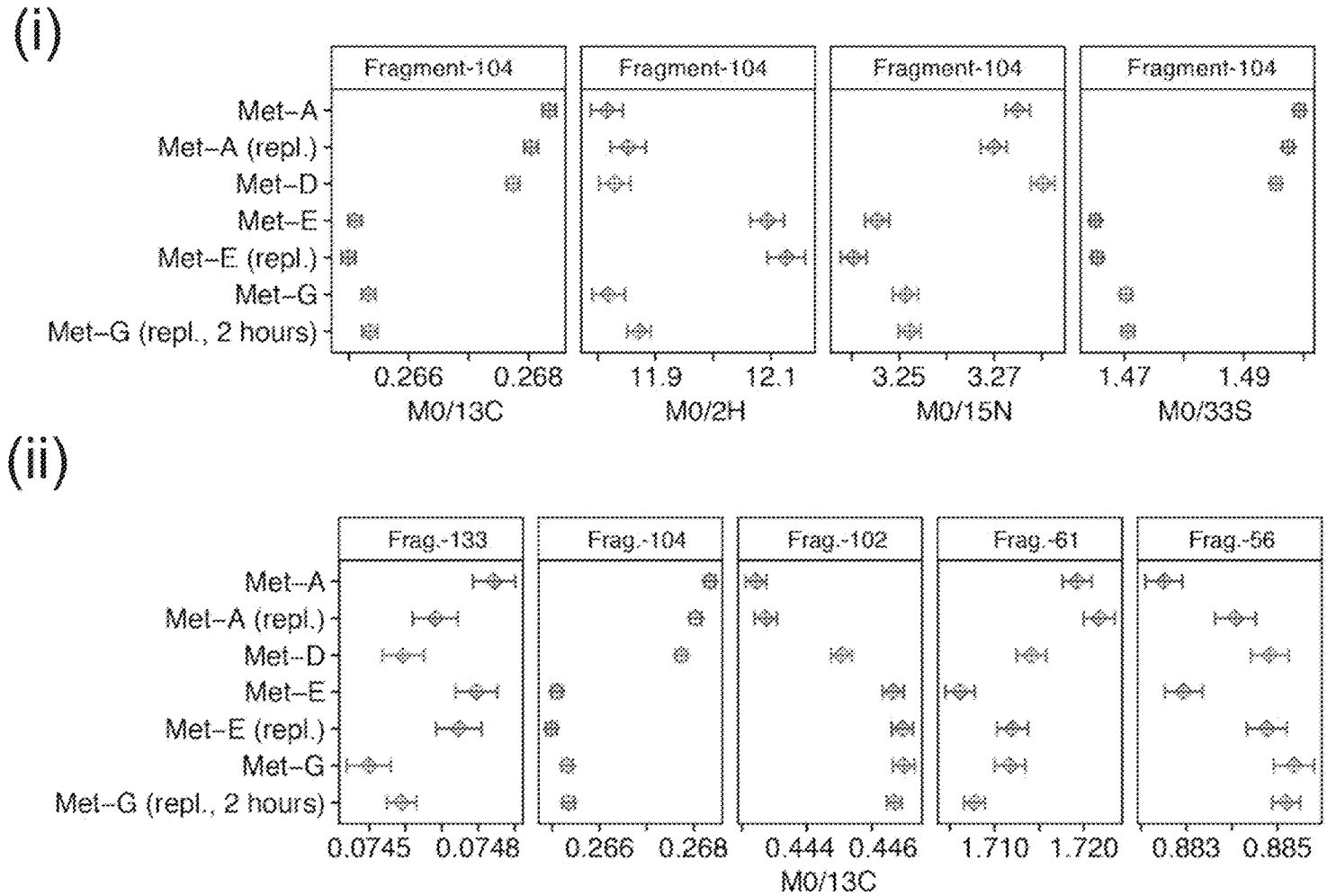

Referring next to FIG. 9, there are shown further high-resolution sets of data values derived from analysis of Met. In FIG. 9*a*(i), there are shown $^{13}C$, $^{2}H$, $^{15}N$ and $^{33}S$ isotope ratios for the Fragment-104 of Met for a plurality of samples: Met-A, Met-A (replicate), Met-D, Met-E, Met-E (replicate), Met-G, and Met-G (Replicate, analysed for two hours). In FIG. 9*a*(ii) there are depicted $^{13}C$ peak intensity ratios for each sample analysed in FIG. 9*a*(i), for each of the five fragments of Met that are resolvable using the experimental setup described throughout the present disclosure.

Met-E, a material that was suspected to be non-synthetic, and Met-G were analysed in duplicate experiments. For Met-E and Met-G, the site-specific carbon isotopic composition is also known by $^{13}C$-NMR enabling the accuracy of the disclosed methods to be analysed. Even though individual infusions were several hours apart, reproducible isotopic differences between Met samples are shown in FIGS. 9*a*(i) and 9*a*(ii). FIGS. 5*a* and 5*b* are a more comprehensive overview of the data of FIGS. 9*a*(i) and 9*a*(ii).

In Met-E and Met-G, the $^{13}C$ peaks of the fragment arising due to decarboxylation, Fragment-104, have smaller peak intensity ratios (M0/$^{13}C$) than Met-A and Met-D, suggesting that Fragment-104 is relatively more enriched in $^{13}C$ in comparison to Met-A and Met-D. This indicates that the carboxyl group in Met-E and Met-G is isotopically lighter. An identical conclusion may be obtained using the low-resolution data described with reference to FIG. 4, where the same pattern in peak intensities amongst the samples is observed. Thus, both the low and high-resolution set of data values are powerful sources of information about the compositions, structures and synthesis histories of molecules.

Figure 9B:
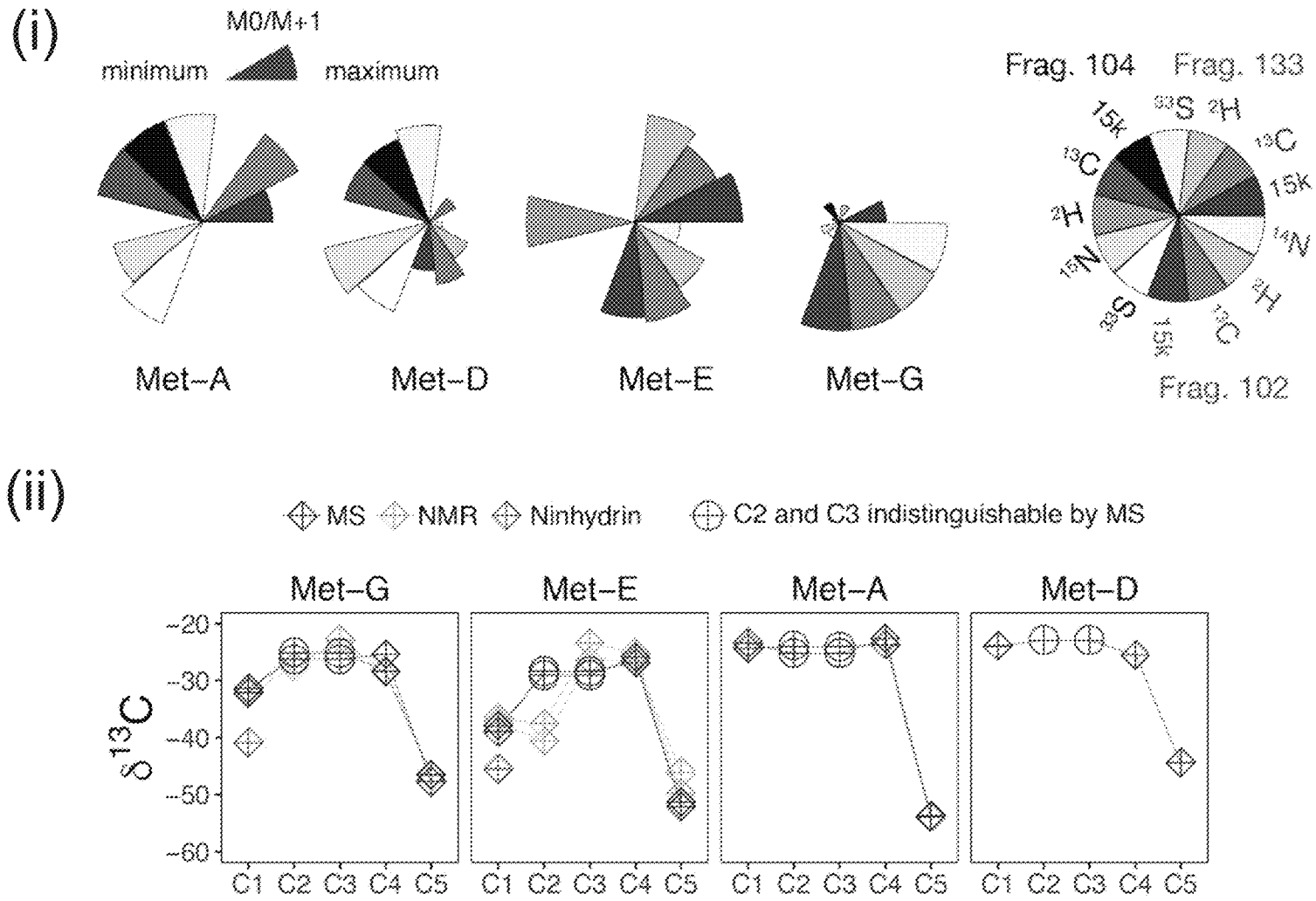
FIG. 9*b* shows visualisations of the data of FIG. 9*a*.

Referring now to FIG. 9*b*(i), there are depicted further visualisations of the information that is obtainable using the disclosed methods relating to high-resolution data. As demonstrated throughout the present disclosure, high-resolution data contains many isotopic dimensions. The similarities and differences between sources of Met are depicted by plotting M0/M+1 as radar plots in which each wedge represents on isotopic dimension, and the radius of each wedge is proportional to the value of the measured M0/M+1 ratio for the specific isotopic dimension. The right hand side of FIG. 9*b*(i) provides a key indicating which peak intensity ratios are depicted.

From these visualisations, it is apparent that Met-E and Met-G are similar in many of the isotopic dimensions that were measured and differ only in dimensions that contribute weakly to the overall isotopic content of M+1 molecular ions. The most notable differences are that Fragment-133 contributes far less to the radar plot for Met-G than to Met-E, and that the $^{2}H$ wedge in Fragment-104 for Met-E is prominent whereas it is negligible in Met-G. Thus, these analyses demonstrate that MS/MS provides a suitable method for discriminating between materials based on isotopic profiles.

Referring next to FIG. 9*b*(ii), there is depicted an illustration of the extent to which MS/MS data can be used to constrain site-specific isotopic compositions, in comparison with NMR and the Ninhydrin reaction. In order to determine site-specific $\delta^{13}C$ values, the $^{13}C$ content of sites C1-C5 may be constrained by bulk $\delta^{13}C$ measurements of samples. Moreover, sites C2 and C3 may be constrained to have identical values due to these two sites not being typically measurable in separate MS/MS fragments. Site-specific $\delta^{13}C$ values may then be determined by minimising the differences between predicted and observed isotope abundances in fragments, by varying $\delta^{13}C$ values of C1, C2 (constrained to be equal to C3) and C4. The $\delta^{13}C$ value of C5 may additionally be constrained by the measured bulk $\delta^{13}C$ values for each sample. Thus, a detailed isotopic profile of a sample can be established.

Very few compounds of even moderate structural complexity have been characterised for their C or H isotopic structures and no naturally occurring biomolecule of comparable size to Met has been constrained for all site-specific isotope ratios. Thus, the methods of the present disclosure provide vastly more thorough isotopic profiles for Met than any previous known work, making it difficult to assess the accuracy of all of the isotopic dimensions that are observed in the present disclosure.

Nevertheless, for the materials Met-G and Met-E, it is possible to compare the experimental findings described herein with site-specific $\delta^{13}C$ values measured in previous studies that used $^{13}C$-NMR. Moreover, it is possible to assess the isotopic content of the carboxyl carbon (C1) with $\delta^{13}C$ values obtained by Ninhydrin treatment, which targets the moiety of the molecule containing this specific carbon atom. For the Ninhydrin method, $\delta^{13}C$ is measured from CO after it has been released from Met.

For the subsequent evaluation, it is important to note that the site-specific isotopic variations derived from the MS/MS methods of the disclosure are not statements about molecular average isotopic inventories of $^{2}H$, $^{13}C$, $^{15}N$, $^{17}O$ or $^{33}S$. This is because the present disclosure does not require there to be any constraints on the abundance of the M+1 molecular ions relative to molecular ions that were excluded (i.e. M0, M+2, and so on). However, a variety of well-established methods for measuring the bulk isotopic composition of H, C, N, O and S isotopes are known, and such data for the Met materials examined in this study are shown in Table 1. The comparisons in Table 2 use the bulk $\delta^{13}C$ of Table 1 and the site-specific $\delta^{13}C$ values from NMR to calculate MS/MS spectra for Met-G, which were then compared to the measured M0/M+1 ratios from Met-G to correct for isotopic fractionation occurring in the MS/MS measurement. Applying the same correction factor to the MS/MS data measured for Met-E provides constraints on the site-specific $\delta^{13}C$ (VPDB) of Met-E, which are then compared to those measured by NMR and the Ninhydrin method.

For the C1 atom of Met-E, it is possible to compare three independent site-specific measurement techniques, as depicted in FIG. 9*b*(ii). The Ninhydrin reaction and NMR both indicate that the C1 in Met-E is isotopically lighter by 4-5‰ than in Met-G. The MS/MS analysis yields a $\delta^{13}C$ of −31.8‰ for Met-G and −38.5‰ for Met-E. In terms of the absolute $\delta^{13}C$ values as well as the differences, Met-E is isotopically lighter than Met-G by 6.7‰, which is consistent with both the NMR and Ninhydrin methods.

For carbon sites at C2 to C5, the MS/MS data can only be compared against NMR, since the Ninhydrin reaction cannot probe the isotopic contents of these sites. As the fragmentation of Met does not include a fragment generated by breaking the C2-C3 bond, these two sites are never observed separately in mass spectrometry and are thus not distinguishable. Therefore, the $\delta^{13}C$ obtained for C2 and C3 represent averages of these two carbon sites. Based on MS/MS, the C2 and C3 of Met-E (−28.7‰) are more isotopically enriched than the C1 position. NMR data suggests a consistent but slightly lighter average of −32.0‰, and NMR additionally reveal that the sites are not equivalent.

Sites C4 and C5 are resolved by MS/MS and exhibit very similar $\delta^{13}C$ values when determined by both NMR and MS/MS.

Thus, the site-specific $\delta^{13}C$ values inferred from MS/MS data are consistent to within about 1‰ with available measurements by NMR and Ninhydrin reaction, as shown in Table 2. Thus, the disclosed methods are consistent with and compare favourably against existing methods for determining site-specific isotopic distributions in molecules, whilst requiring far less sample sizes.

Whilst no site-specific isotope constraints are available from NMR analysis for the other Met materials in the high-resolution set of data values, their isotopic composition can nevertheless be calculated, as illustrated in FIG. 9*b*(ii). Met-A and Met-D have similar $\delta^{13}C$ isotopic structures and the carboxyl carbon C1 in these two materials is not depleted relative to sites C2-C4, in clear contrast with Met-G and Met-E. Thus, the methods of the disclosure provide robust, reliable methods for discriminating between materials.

Thus, the methods of the present disclosure are demonstrably capable of providing reliable molecular profiles that can be used to discriminate between the sources of materials. A specific application of such profiles is when attempting to identify the source of a known or unknown material. In this case, the sample may be analysed using either the low-resolution or the high-resolution methods described above and an isotopic profile of the sample that is indicative of the isotopic content of the sample is thereby obtained. This profile comprises a set of data values and these values may be searched in a data store or database. Such a data store may comprise profiles for substances that have been identified previously and which were obtained from known sources. Thus, if a profile in the data store has values that are sufficiently similar to the profile of the unknown substance (i.e. a similarity condition is met), then the profile in the store may be used to identify the source, supplier, age, identity, or any other characteristic of the substance that may be associated with the identified profile in the data store. Any known similarity measure for comparing sets of data values may be used such as, for instance, a Jaccard distance.

Throughout the disclosure, the effectiveness of the disclosed methods has been demonstrated with reference to Met. However, it will be appreciated that the methods of the disclosure are applicable to other substances. For instance, the disclosed mass spectrometry systems would be capable of resolving many isotopic peaks in mass spectra of organic molecules having comparable size to Met. Thus, any substance with a mass of up to approximately 150 atomic mass units would be suitable for analysis using the high-resolution mode of operation, and the low-resolution mode may probe significantly higher masses again. In particular, available mass spectrometry systems may be capable of performing high-resolution analysis on molecules having masses of up to 250, 500, 1000, or as high as 10-100 kDa in certain cases.

The above methods and illustrative data relate to analyses of analytes that are delivered to an electrospray ionisation ion source as solutes dissolved in polar solvents. All such measurements presented above were made using the Q Exactive™ HF mass spectrometer. However, the above methods are not limited to this hardware and other apparatus and forms of analytes may be used. For instance, gas ion source ionisation may be used as a means of studying non-polar, volatile analytes. In particular, similar methods as described above can be used to perform site-specific isotopic analysis of non-polar, volatile compounds introduced into an electron impact (EI) gas ion source. Such measurements are readily combined with gas chromatographic (GC) separation of volatile analytes, facilitating studies of the isotopic structures of components of complex mixtures (for instance by injection of mixtures into a GC, followed by introduction of eluted peaks into the gas ion source of an orbital trapping mass spectrometer). Such measurements can be performed using the Q Exactive™ GC mass spectrometer.

Specifically, the above techniques of subjecting the M+1 peak to fragmentation and analysis can be used to constrain the site-specific distribution of 13C and D among fragment ions of n-heptane and pyrene. In both cases, analyte may be dissolved in non-polar solvent, injected into a GC, and the eluted peak was trapped in a passivated stainless steel reservoir and then flushed with helium into the EI ion source of a Q Exactive™ GC mass spectrometer. The M+1 molecular ion peak was isolated using the AQS quadrupole mass filter. Then, isolated ions were subjected to collisional fragmentation in the HCD cell, and fragment ions were injected into the Orbitrap™ analyser for mass, analysis. Thus, in general terms, the methods of the present disclosure may comprise generating ions of the molecule by electrospray ionisation or electron ionisation (EI, otherwise known as electron impact ionisation or electron bombardment ionisation).

The principal difference between generating ions of the molecule by electron ionisation rather than electrospray ionisation is that ionisation in EI ion sources typically yields abundant fragment ions of the parent analyte molecule. Thus, whereas application of the M+1 technique to molecules ionised in an electrospray ionisation ion source typically isolates and fragments a molecular ion peak, application of the same principles with a mass spectrometer having an EI ion source may allow the same methods to be applied to an isolated M+1 peak of a fragment ion (i.e., isolating that fragment ion and subjecting it to a second fragmentation in the HCD cell prior to mass analysis). This additional capability may be highly advantageous for certain analytes having certain structures and EI fragmentation patterns. In favourable cases, this method allows the characterisation of the site-specific isotopic structure of one or more specific moieties of a parent analyte molecule. For example, EI ionization of the methyl 35 ester derivative of testosterone yields a fragment ion comprised of the 'A' ring of the parent molecule. When this fragment ion is subjected to analysis of the M+1 peak, it is possible to constrain the site-specific distribution of $^{13}C$ and D between nonequivalent atomic sites in the 'A' ring. Thus, the isotopic content of sites in a molecule can be constrained to a high degree of specificity.

The techniques described herein utilise the fragmentation patterns of various molecules to elucidate information about analytes. For instance, collisional fragmentation, such as in the HCD cell of a 0 Exactive™ mass spectrometer, is often suitable for fragmenting isolated ions into two or more fragments composed of non-equivalent mixtures of atomic sites. Some compounds, such as polycyclic aromatic hydrocarbons, are highly resistant to collisional fragmentation under typical collisional energies of from 10 to 30 eV. In such cases, Q Exactive™ GC systems can be used to subject the isolated M+1 molecular ion of pyrene to collisional fragmentation in the HCD cell at collisional energies of from 50 to 70 eV. Such extreme collisional energies are capable of breaking resistant ionic species into smaller fragments, allowing measurements of isotopic structure by mass analysing M+1 ions. Thus, it will be appreciated that a variety of collisional energies may be used depending on the particular analyte, with preferred energy ranges being 10 to 30 eV and 50 to 70 eV.

Although the disclosure has been described with reference to particular types of data, devices and applications, and whilst the disclosure provides particular advantages in such cases, as discussed herein the disclosure may be applied to other types of data, devices and applications. For instance, any references to a mass selector may be taken to refer instead to a mass filter and any references to a fragmentation device may be taken to refer to a fragmentation cell. Each feature disclosed in this specification, unless stated otherwise, may be replaced by alternative features serving the same, equivalent or similar purpose. Thus, unless stated otherwise, each feature disclosed is one example only of a generic series of equivalent or similar features.

As used herein, including in the claims, unless the context indicates otherwise, singular forms of the terms herein are to be construed as including the plural form and, where the context allows, vice versa. For instance, unless the context indicates otherwise, a singular reference herein including in the claims, such as "a" or "an" (such as a peak intensity ratio, or a variant peak) means "one or more" (for instance, one or more peak intensity ratios, or one or more variant peaks). Throughout the description and claims of this disclosure, the words "comprise", "including", "having" and "contain" and variations of the words, for example "comprising" and "comprises" or similar, mean "including but not limited to", and are not intended to (and do not) exclude other components The use of any and all examples, or exemplary language ("for instance", "such as", "for example" and like language) provided herein, is intended merely to better illustrate the disclosure and does not indicate a limitation on the scope of the disclosure unless otherwise claimed. No language in the specification should be construed as indicating any non-claimed element as essential to the practice of the disclosure.

Any steps described in this specification may be performed in any order or simultaneously unless stated or the context requires otherwise.

All of the aspects and/or features disclosed in this specification may be combined in any combination, except combinations where at least some of such features and/or steps are mutually exclusive. In particular, the preferred features of the disclosure are applicable to all aspects of the disclosure and may be used in any combination. Likewise, features described in non-essential combinations may be used separately (not in combination).

The invention claimed is:

1. A method for determining an isotopic profile for a molecule, the isotopic profile indicative of an isotopic content for the molecule, the method comprising:

mass selecting ions of the molecule in a mass window, the mass window excluding a mass for a monoisotopic molecular ion and including a mass for at least one isotopic variant of the monoisotopic molecular ion;

fragmenting the mass selected ions into fragment ions;

performing mass analysis on one or more of the fragment ions to produce a mass spectrum; and determining the isotopic profile for the molecule, the isotopic profile comprising at least one data value, each data value calculated for a fragment ion as a function of intensities of multiple peaks in the mass spectrum.

2. The method of claim 1, wherein the mass spectrum comprises one or more peak groups, each peak group comprising:

a principal peak associated with a monoisotopic fragment ion; and at least one variant peak, each variant peak associated with an isotopic variant of the monoisotopic fragment ion.

3. The method of claim 2, wherein fragmenting the mass selected ions comprises generating at least two fragment ions, each of the at least two fragment ions associated with respective, different peak groups in the mass spectrum.

4. The method of claim 2, comprising determining each data value in the isotopic profile for a respective peak group, each data value being calculated as a peak intensity ratio between the principal peak and the variant peak of the respective peak group.

5. The method of claim 1, wherein the at least one isotopic variant of the monoisotopic molecular ion is a heavy isotopologue.

6. The method of claim 5, wherein at least one isotopic variant has a nominal mass of M+x, wherein M is the mass of the monoisotopic ion and x is an integer (1, 2, 3, . . . ).

7. The method of claim 6, wherein at least one isotopic variant has a nominal mass of M+x and at least one isotopic variant has a nominal mass of M+y, wherein y is an integer (1, 2, 3, . . . ) and y>x, preferably wherein y=x+1.

8. The method of any of claim 5, wherein at least one isotopic variant is selected from: $^{2}H$; $^{13}C$; $^{14}C$; $^{15}N$; $^{17}O$; $^{18}O$; $^{33}S$; $^{34}S$; $^{37}Cl$; and $^{81}Br$.

9. The method of claim 5, wherein at least one isotopic variant comprises a clumped isotope.

10. The method of claim 1, wherein determining the isotopic profile comprises associating each data value in the isotopic profile with a mass value for a fragment ion.

11. The method of claim 1, wherein the isotopic profile comprises an isotopic positional distribution.

12. The method of claim 11, wherein determining the isotopic positional distribution comprises associating each data value with a moiety of the molecule.

13. The method of claim 12, wherein associating each data value with a moiety in the molecule comprises determining moieties of the molecule that correspond to moieties of the fragment ions.

14. The method of claim 1, further comprising comparing the at least one data value in the isotopic profile with at least one corresponding data value of an isotopic profile of a reference sample of the molecule.

15. The method of claim 1, wherein the mass window is centered on a mass for the isotopic variant of the monoisotopic molecular ion.

16. The method of claim 1, wherein the molecular ion is a fragmention.

17. The method of claim 1, wherein the mass window has a width that is less than 2 Daltons or less than 1 Dalton.

18. The method of claim 1, comprising performing mass analysis at a resolution of less than 20000.

19. The method of claim 1, comprising performing high-resolution mass analysis at a resolution of at least 50000.

20. The method of claim 1, comprising determining a resolution for the mass analysis as a function of mass differences between isotopologues in the molecule.

21. The method of claim 1, comprising performing mass analysis using one or more of an orbital trapping mass analyser, a quadrupole mass analyser, a time-of-flight mass analyser, an ion trap mass analyser having an RF trap or an electrostatic trap, a Fourier-transform ion cyclotron resonance mass analyser, and a magnetic sector mass analyser.

22. The method of claim 1, comprising fragmenting the mass selected ions by performing one or more of collision-induced dissociation, ultraviolet photodissociation, infrared multiphoton dissociation, electron-transfer dissociation, and electron-capture dissociation.

23. The method of claim 1, comprising generating the ions of the molecule by electrospray ionisation or electron ionisation.

24. The method of claim 1, wherein fragmenting the mass selected ions comprises subjecting the mass selected ions to collisional energies of: up to 500 eV; up to 100 eV; from 10 to 70 eV; from 10 to 30 eV; or from 50 to 70 eV.

25. A computer program, configured when operated by a processor to cause a mass spectrometry system to carry out the method of claim 1.

26. A mass spectrometry system configured to carry out the method of claim 1.

27. A method for identifying a sample, the method comprising: determining an isotopic profile for the sample using the method of claim 1;

determining a similarity measure between the determined isotopic profile and an isotopic profile in a data store; and identifying the sample as corresponding with a record in the data store when the similarity measure satisfies a threshold condition.

* * * * *